US010858232B2

(12) United States Patent
Carpenter et al.

(10) Patent No.: US 10,858,232 B2
(45) Date of Patent: Dec. 8, 2020

(54) SYSTEMS AND METHODS FOR INCORPORATING MICRO-INGREDIENT DISPENSING FUNCTIONALITY INTO A MACRO-INGREDIENT BEVERAGE DISPENSING SYSTEM

(71) Applicant: The Coca-Cola Company, Atlanta, GA (US)

(72) Inventors: Gregg Carpenter, Marietta, GA (US); Arthur G. Rudick, Ormond Beach, FL (US); David Slagley, Roswell, GA (US); Dick P. Welch, Marietta, GA (US); Daniel S. Quartarone, Hoschton, GA (US); Douglas Jon McDougall, Atlanta, GA (US)

(73) Assignee: The Coca-Cola Company, Atlanta, GA (US)

( * ) Notice: Subject to any disclaimer, the term of this patent is extended or adjusted under 35 U.S.C. 154(b) by 0 days.

(21) Appl. No.: 16/478,370

(22) PCT Filed: Jan. 25, 2018

(86) PCT No.: PCT/US2018/015132
§ 371 (c)(1),
(2) Date: Jul. 16, 2019

(87) PCT Pub. No.: WO2018/140546
PCT Pub. Date: Aug. 2, 2018

(65) Prior Publication Data
US 2019/0330043 A1 Oct. 31, 2019

Related U.S. Application Data

(60) Provisional application No. 62/451,407, filed on Jan. 27, 2017, provisional application No. 62/470,457, filed on Mar. 13, 2017.

(51) Int. Cl.
*B67D 1/00* (2006.01)
*B67D 1/08* (2006.01)

(52) U.S. Cl.
CPC ..... *B67D 1/0037* (2013.01); *B67D 1/0051* (2013.01); *B67D 1/0888* (2013.01); *B67D 1/0892* (2013.01)

(58) Field of Classification Search
CPC .. B67D 1/0037; B67D 1/0051; B67D 1/0888; B67D 1/0892
(Continued)

(56) References Cited

U.S. PATENT DOCUMENTS

2007/0205220 A1* 9/2007 Rudick ..... B67D 1/07 222/129.4
2007/0205221 A1* 9/2007 Carpenter ..... B67D 1/0032 222/129.4
(Continued)

FOREIGN PATENT DOCUMENTS

WO WO-2015175494 A1 * 11/2015 ..... B67D 1/004
WO 2016/057869 A1 4/2016

OTHER PUBLICATIONS

EP Search Report, EP Appl. 18745301.4, dated Sep. 15, 2020 (9 pages).

*Primary Examiner* — Vishal Pancholi
(74) *Attorney, Agent, or Firm* — Eversheds Sutherland (US) LLP

(57) ABSTRACT

A system for dispensing one or more beverages is disclosed. The system may include a nozzle, one or more macro-ingredients in fluid communication with the nozzle, and a number of micro-ingredients in fluid communication with the nozzle. The nozzle is configured to dispense a beverage formed by the one or more macro-ingredients and one or more of the micro-ingredients.

1 Claim, 18 Drawing Sheets

(58) Field of Classification Search
USPC ..... 222/100
See application file for complete search history.

(56) References Cited

U.S. PATENT DOCUMENTS

| | | | | |
|---|---|---|---|---|
| 2012/0325845 | A1* | 12/2012 | Newman | B67D 1/127 222/1 |
| 2013/0292407 | A1* | 11/2013 | Beavis | B67D 1/0036 222/1 |
| 2014/0263406 | A1* | 9/2014 | Green | B67D 1/0065 222/1 |
| 2016/0069716 | A1 | 3/2016 | Beavis et al. | |
| 2016/0325980 | A1* | 11/2016 | Sawhney | G06F 3/0482 |
| 2017/0081163 | A1* | 3/2017 | Gatipon | B67D 1/0888 |

* cited by examiner

SYSTEMS AND METHODS FOR INCORPORATING MICRO-INGREDIENT DISPENSING FUNCTIONALITY INTO A MACRO-INGREDIENT BEVERAGE DISPENSING SYSTEM

CROSS-REFERENCE TO RELATED APPLICATIONS

The disclosure claims priority to and the benefit of U.S. provisional patent application No. 62/451,407, filed Jan. 27, 2017, and U.S. provisional patent application No. 62/470,457, filed Mar. 13, 2017, which are both incorporated by reference herein in their entirety.

FIELD OF THE DISCLOSURE

The disclosure generally relates to beverage dispensers and more particularly relates to systems and methods for incorporating micro-ingredient dispensing functionality into a macro-ingredient beverage dispensing system to create a hybrid beverage dispenser that includes both macro-ingredient and micro-ingredient dispensing functionality.

BACKGROUND

Typical fountain beverage dispensing units (such as legacy and legacy plus) do not include micro-ingredient dispensing functionality because the ingredient modules (including pumping and valve mechanisms used to deliver and meter the ingredients to the nozzle) used therein are not capable of delivering small enough quantities of beverage micro-ingredients to yield a beverage within specifications. Recent legacy beverage dispensing units may include levers and buttons and one or more multi-flavor nozzles (per system) and a touch screen user interface, sometimes referred to a legacy plus beverage dispensing unit. Legacy and legacy plus beverage dispensing units may deliver a beverage base (e.g., a macro-ingredient bag-in-box syrup) and a diluent (e.g., water or carbonated water) to a nozzle to produce a finished beverage. Typically, the flow rate of the beverage base syrup is controlled with a mechanical flow control valve that is adjusted via a set screw. Likewise, the flow rate of the diluent is also controlled by a separate mechanical flow control valve that is adjustable via a set screw. The legacy and legacy plus beverage dispensers may be calibrated by a technician adjusting the set screws on the mechanical flow control valves to ensure the proper ratio of beverage base and diluent are dispensed to mix and produce a finished beverage.

Some legacy and legacy plus beverage dispensers may also allow for the addition of flavor shots to the finished beverage. The flavor shots may be added at a separate flavor shot nozzle from the nozzle that dispenses the finished beverage or the flavor shot may be added at the same nozzle as the one that dispenses the finished beverage. When the flavor shot is added at the same nozzle as the finished beverage, the flavor shot may be added at the beginning or end of the dispense of the finished beverage, or may be continuously dosed into the finished beverage as it is dispensed. However, the flow rate of the flavor shot may also be controlled via a mechanical flow control valve that is adjustable via a set screw. The flow rate of the flavor shot may be calibrated with respect to the flow rate of the beverage base syrup. Because the flow rate of the water is already fixed with respect to the flow rate of the beverage base syrup, the finished beverage ends up being diluted with the addition of the flavor shot.

For example, in a 10 fl. oz. beverage, there may be 8 fl. oz. of carbonated water and 2 fl. oz. of beverage base syrup dispensed to mix and produce the finished beverage. However, when adding a flavor shot based on the above described control mechanisms, in a 10 fl. oz. beverage, there may be approximately 7.27 fl. oz. of carbonated water, 1.82 fl. oz. of beverage base syrup, and 0.91 fl. oz. of the flavor shot. The above example is merely illustrative and assumes mechanical flow control valve for the flavor shot is adjusted with respect to the mechanical flow control valve of the beverage base syrup to provide a 2:1 ratio between the beverage base syrup and the flavor shot. The ratio of the flavor shot may also be set with respect to the diluent (e.g., water or carbonated water) with a similar end result.

Therefore, although legacy and legacy plus units may be capable of dispensing a beverage with a flavor shot, it may be desirable to improve the dispensing capabilities of the legacy and legacy plus units by incorporating micro-ingredient dispensing functionality into the macro-units.

SUMMARY

Some or all of the above needs and/or problems may be addressed by certain embodiments of the disclosure. According to an embodiment, a system for dispensing one or more beverages is disclosed. The system may include a nozzle, one or more macro-ingredients in fluid communication with the nozzle, and a number of micro-ingredients in fluid communication with the nozzle. The nozzle is configured to dispense a beverage formed by the one or more macro-ingredients and one or more of the micro-ingredients.

Other features and aspects of the disclosure will be apparent or will become apparent to one with ordinary skill in the art upon examination of the following figures and the detailed description. All other features and aspects, as well as other system, method, and assembly embodiments, are intended to be included within the description and are intended to be within the scope of the accompanying claims.

BRIEF DESCRIPTION OF THE DRAWINGS

The detailed description is set forth with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

DETAILED DESCRIPTION

Figure 1:
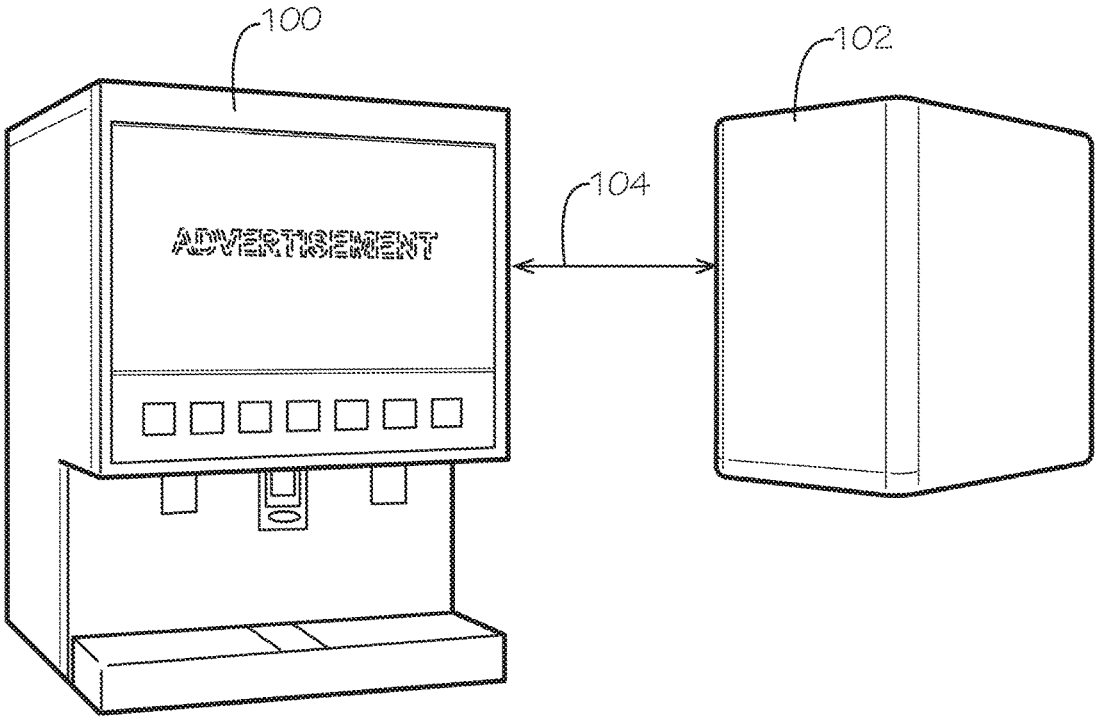
FIG. 1 depicts a system having micro-ingredient dispensing functionality in accordance with one or more embodiments of the disclosure.

Described herein are example systems and methods for incorporating micro-ingredients into a macro-ingredient beverage dispensing system (such as a legacy or legacy plus unit), either as a retro-fit kit, add-on module, or integrated within the beverage dispensing system. For example, a beverage dispensing system (which may include one or more macro-ingredients) may be retrofitted with a micro-ingredient dispensing systems (which may include a number of micro-ingredients and/or other macro-ingredients). The combination of the two systems may provide micro-dosing functionality that was not otherwise available in the beverage dispensing system. Such micro-dosing functionality may increase the dispensing capabilities of the beverage dispensing system and improve the quality of the beverage dispensed by the beverage dispensing system.

Generally described, the macro-ingredients may have reconstitution ratios in the range from full strength (no dilution) to about six (6) to one (1) (but generally less than about ten (10) to one (1)). As used herein, the reconstitution ratio refers to the ratio of diluent (e.g., water or carbonated water) to beverage ingredient. Therefore, a macro-ingredient with a 5:1 reconstitution ratio refers to a macro-ingredient that is to be dispensed and mixed with five parts diluent for every part of the macro-ingredient in the finished beverage. Many macro-ingredients may have reconstitution ratios in the range of about 3:1 to 5.5:1, including 4.5:1, 4.75:1, 5:1, 5.25:1, 5.5:1, and 8:1 reconstitution ratios.

The macro-ingredients may include sweeteners such as sugar syrup, HFCS ("High Fructose Corn Syrup"), FIS ("Fully Inverted Sugar"), MIS ("Medium Inverted Sugar"), mid-calorie sweeteners comprised of nutritive and non-nutritive or high intensity sweetener blends, and other such nutritive sweeteners that are difficult to pump and accurately meter at concentrations greater than about 10:1—particularly after having been cooled to standard beverage dispensing temperatures of around 35-45° F. An erithritol sweetener may also be considered a macro-ingredient sweetener when used as the primary sweetener source for a beverage, though typically erythritol will be blended with other sweetener sources and used in solutions with higher reconstitution ratios such that it may be considered a micro-ingredient as described below.

The macro-ingredients may also include traditional BIB ("bag-in-box") flavored syrups (e.g., COCA-COLA bag-in-box syrup) which contains all of a finished beverage's sweetener, flavors, and acids that when dispensed is to be mixed with a diluent source such as plain or carbonated water in ratios of around 3:1 to 6:1 of diluent to the syrup. Other typical macro-ingredients may include concentrated extracts, purees, juice concentrates, dairy products, soy concentrates, and rice concentrates.

The macro-ingredient may also include macro-ingredient base products. Such macro-ingredient base products may include the sweetener as well as some common flavorings, acids, and other common components of a plurality of different finished beverages. However, one or more additional beverage ingredients (either micro-ingredients or macro-ingredients as described herein) other than the diluent are to be dispensed and mix with the macro-ingredient base product to produce a particular finished beverage. In other words, the macro-ingredient base product may be dispensed and mixed with a first micro-ingredient non-sweetener flavor component to produce a first finished beverage. The same macro-ingredient base product may be dispense and mixed with a second micro-ingredient non-sweetener flavor component to produce a second finished beverage.

The macro-ingredients described above may be stored in a conventional bag-in-box container in, at and/or remote from the dispenser. The viscosity of the macro-ingredients may range from about 1 to about 10,000 centipoise and generally over 100 centipoises or so when chilled. Other types of macro-ingredients may be used herein.

The micro-ingredients may have reconstitution ratios ranging from about ten (10) to one (1) and higher. Specifically, many micro-ingredients may have reconstitution ratios in the range of about 20:1, to 50:1, to 100:1, to 300:1, or higher. The viscosities of the micro-ingredients typically range from about one (1) to about six (6) centipoise or so, but may vary from this range. In some instances the viscosities of the micro-ingredients may be forty (40) centipoise or less. Examples of micro-ingredients include natural or artificial flavors; flavor additives; natural or artificial colors; artificial sweeteners (high potency, nonnutritive, or otherwise); antifoam agents, nonnutritive ingredients, additives for controlling tartness, e.g., citric acid or potassium citrate; functional additives such as vitamins, minerals, herbal extracts, nutricuticals; and over the counter (or otherwise) medicines such as pseudoephedrine, acetaminophen; and similar types of ingredients. Various acids may be used in micro-ingredients including food acid concentrates such as phosphoric acid, citric acid, malic acid, or any other such common food acids. Various types of alcohols may be used as either macro- or micro-ingredients. The micro-ingredients may be in liquid, gaseous, or powder form (and/or combinations thereof including soluble and suspended ingredients in a variety of media, including water, organic solvents, and oils). Other types of micro-ingredients may be used herein.

Typically, micro-ingredients for a finished beverage product include separately stored non-sweetener beverage component concentrates that constitute the flavor components of the finished beverage. Non-sweetener beverage component concentrates do not act as a primary sweetener source for the finished beverage and do not contain added sweeteners, though some non-sweetener beverage component concentrates may have sweet tasting flavor components or flavor components that are perceived as sweet in them. These non-sweetener beverage component concentrates may include the food acid concentrate and food acid-degradable (or non-acid) concentrate components of the flavor, such as described in commonly owned U.S. patent application Ser. No. 11/276,553, entitled "Methods and Apparatus for Making Compositions Comprising and Acid and Acid Degradable Component and/or Compositions Comprising a Plurality of Selectable Components," which is herein incorporated by reference in its entirety. As noted above, micro-ingredients may have reconstitution ratios ranging from about ten (10) to one (1) and higher, where the micro-ingredients for the separately stored non-sweetener beverage component concentrates that constitute the flavor components of the finished beverage typically have reconstitution ratios ranging from 50:1, 75:1, 100:1, 150:1, 300:1, or higher.

For example, the non-sweetener flavor components of a cola finished beverage may be provided from separately stored first non-sweetener beverage component concentrate and a second non-sweetener beverage component concentrate. The first non-sweetener beverage component concentrate may comprise the food acid concentrate components of the cola finished beverage, such as phosphoric acid. The second non-sweetener beverage component concentrate may comprise the food acid-degradable concentrate components of the cola finished beverage, such as flavor oils that would react with and impact the taste and shelf life of a non-sweetener beverage component concentrate were they to be stored with the phosphoric acid or other food acid concentrate components separately stored in the first non-sweetener component concentrate. While the second non-sweetener beverage component concentrate does not include the food acid concentrate components of the first non-sweetener beverage component concentrate (e.g., phosphoric acid), the second non-sweetener beverage component concentrate may still be a high-acid beverage component solution (e.g., pH less than 4.6).

A finished beverage may have a plurality of non-sweetener concentrate components of the flavor other than the acid concentrate component of the finished beverage. For example, the non-sweetener flavor components of a cherry cola finished beverage may be provided from the separately stored non-sweetener beverage component concentrates described in the above example as well as a cherry non-sweetener component concentrate. The cherry non-sweetener component concentrate may be dispensed in an amount consistent with a recipe for the cherry cola finished beverage. Such a recipe may have more, less, or the same amount of the cherry non-sweetener component concentrate than other recipes for other finished beverages that include the cherry non-sweetener component concentrate. For example, the amount of cherry specified in the recipe for a cherry cola finished beverage may be more than the amount of cherry specified in the recipe for a cherry lemon-lime finished beverage to provide an optimal taste profile for each of the finished beverage versions. Such recipe-based flavor versions of finished beverages are to be contrasted with the addition of flavor additives or flavor shots as described below.

Other typical micro-ingredients for a finished beverage product may include micro-ingredient sweeteners. Micro-ingredient sweeteners may include high intensity sweeteners such as aspartame, Ace-K, steviol glycosides (e.g., Reb A, Reb M), sucralose, saccharin, or combinations thereof. Micro-ingredient sweeteners may also include erythritol when dispensed in combination with one or more other sweetener sources or when using blends of erythritol and one or more high intensity sweeteners as a single sweetener source.

Other typical micro-ingredients for supplementing a finished beverage product may include micro-ingredient flavor additives. Micro-ingredient flavor additives may include additional flavor options that can be added to a base beverage flavor. The micro-ingredient flavor additives may be non-sweetener beverage component concentrates. For example, a base beverage may be a cola flavored beverage, whereas cherry, lime, lemon, orange, and the like may be added to the cola beverage as flavor additives, sometimes referred to as flavor shots. In contrast to recipe-based flavor versions of finished beverages, the amount of micro-ingredient flavor additive added to supplement a finished beverage may be consistent among different finished beverages. For example, the amount of cherry non-sweetener component concentrate included as a flavor additive or flavor shot in a cola finished beverage may be the same as the amount of cherry non-sweetener component concentrate included as a flavor additive or flavor shot in a lemon-lime finished beverage. Additionally, whereas a recipe-based flavor version of a finished beverage is selectable via a single finished beverage selection icon or button (e.g., cherry cola icon/button), a flavor additive or flavor shot is a supplemental selection in addition to the finished beverage selection icon or button (e.g., cola icon/button selection followed by a cherry icon/button selection).

As is generally understood, such beverage selections may be made through a touchscreen user interface or other typical beverage user interface selection mechanism (e.g., buttons) on a beverage dispenser. The selected beverage, including any selected flavor additives, may then be dispensed upon the beverage dispenser receiving a further dispense command through a separate dispense button on the touchscreen user interface or through interaction with a separate pour mechanism such as a pour button (electromechanical, capacitive touch, or otherwise) or pour lever.

In the traditional BIB flavored syrup delivery of a finished beverage, a macro-ingredient flavored syrup that contains all of a finished beverage's sweetener, flavors, and acids is mixed with a diluent source such as plain or carbonated water in ratios of around 3:1 to 6:1 of diluent to the syrup. In contrast, for a micro-ingredient delivery of a finished beverage, the sweetener(s) and the non-sweetener beverage component concentrates of the finished beverage are all separately stored and mixed together about a nozzle when the finished beverage is dispensed. Example nozzles suitable for dispensing of such micro-ingredients include those described in commonly owned U.S. provisional patent application Ser. No. 62/433,886, entitled "Dispensing Nozzle Assembly," PCT patent application Ser. No. PCT/US15/026657, entitled "Common Dispensing Nozzle Assembly," U.S. Pat. No. 7,866,509, entitled "Dispensing Nozzle Assembly," or U.S. Pat. No. 7,578,415, entitled "Dispensing Nozzle Assembly," which are all herein incorporated by reference in their entirety.

In operation, the beverage dispenser may dispense finished beverages from any one or more of the macro-ingredient or micro-ingredient sources described above. For example, similar to the traditional BIB flavored syrup delivery of a finished beverage, a macro-ingredient flavored syrup may be dispensed with a diluent source such as plain or carbonated water to produce a finished beverage. Additionally, the traditional BIB flavored syrup may be dispensed with the diluent and one or more micro-ingredient flavor additives to increase the variety of beverages offered by the beverage dispenser.

Micro-ingredient-based finished beverages may be dispensed by separately dispensing each of the two or more non-sweetener beverage component concentrates of the finished beverage along with a sweetener and diluent. The sweetener may be a macro-ingredient sweetener or a micro-ingredient sweetener and the diluent may be water or carbonated water. For example, a micro-ingredient-based cola finished beverage may be dispensed by separately dispensing a food acid concentrate components of the cola finished beverage, such as phosphoric acid, food acid-degradable concentrate components of the cola finished beverage, such as flavor oils, macro-ingredient sweetener, such as HFCS, and carbonated water. In another example, a micro-ingredient-based diet-cola finished beverage may be dispensed by separately dispensing a food acid concentrate components of the diet-cola finished beverage, food acid-degradable concentrate components of the diet-cola finished beverage, micro-ingredient sweetener, such as aspartame or an aspartame blend, and carbonated water. As a further example, a mid-calorie micro-ingredient-based cola finished beverage may be dispensed by separately dispensing a food acid concentrate components of the mid-calorie cola finished beverage, food acid-degradable concentrate components of the mid-calorie cola finished beverage, a reduced amount of a macro-ingredient sweetener, a reduced amount of a micro-ingredient sweetener, and carbonated water. By reduced amount of macro-ingredient and micro-ingredient sweeteners, it is meant to be in comparison with the amount of macro-ingredient or micro-ingredient sweetener used in the cola finished beverage and diet-cola finished beverage. As a final example, a supplementally flavored micro-ingredient-based beverage, such as a cherry cola beverage or a cola beverage with an orange flavor shot, may be dispensed by separately dispensing a food acid concentrate components of the flavored cola finished beverage, food acid-degradable concentrate components of the flavored cola finished beverage, one or more non-sweetener micro-ingredient flavor additives (dispensed as either as a recipe-based flavor version of a finished beverage or a flavor shot), a sweetener (macro-ingredient sweetener, micro-ingredient sweetener, or combinations thereof), and carbonated water. While the above examples are provided for carbonated beverages, they apply to still beverages as well by substituting carbonated water with plain water.

The various ingredients may be dispensed by the beverage dispenser in a continuous pour mode where the appropriate ingredients in the appropriate proportions (e.g., in a predetermined ratio) for a given flow rate of the beverage being dispensed. In other words, as opposed to a conventional batch operation where a predetermined amount of ingredients are combined, the beverage dispenser provides for continuous mixing and flows in the correct ratio of ingredients for a pour of any volume. This continuous mix and flow method can also be applied to the dispensing of a particular size beverage selected by the selection of a beverage size button by setting a predetermined dispensing time for each size of beverage.

FIG. 1 depicts a first beverage dispenser 100. The first beverage dispenser 100 may be referred to as a macro-ingredient unit, an existing unit, a macro-unit, a legacy unit, a legacy plus unit, a fountain dispenser, and/or a post-mix beverage dispenser. For simplicity, the first beverage dispenser 100 may be referred to hereafter as a macro-unit 100. The macro-unit 100 may be any macro-ingredient dispensing unit configured to receive a beverage selection and dispense a macro-ingredient and diluent to mix and produce a finished beverage. The macro-unit 100 may be any beverage dispenser that does not include micro-ingredient dispensing functionality.

As discussed in greater detail below, in some instances, the macro-unit 100 may be in electrical and/or mechanical communication 104 with a second beverage dispenser 102. The second beverage dispenser 102 may be referred to as a micro-ingredient unit, a micro-unit, a retrofit unit, and/or a sidecar unit. For simplicity, the second beverage dispenser 102 may be referred to hereafter as a micro-unit 102. The micro-unit 102 may be any beverage dispenser that includes micro-ingredient dispensing functionality and/or macro-ingredient functionality. The micro-unit 102 may be integrated into the macro-unit 100 (or vice versa) to form a single hybrid dispensing unit that includes both macro-ingredient and micro-ingredient dispensing functionality. In some embodiments, the micro-unit 102 may be incorporated into the housing of the macro-unit 100. In other embodiment, the micro-unit 102 may be retrofitted into the macro-unit 100. In yet other embodiments, the micro-unit 102 may be a sidecar solution that is integrated into the macro-unit 100. The micro-unit 102 may include any beverage dispenser that includes micro-ingredient dispensing functionality.

Figure 9:
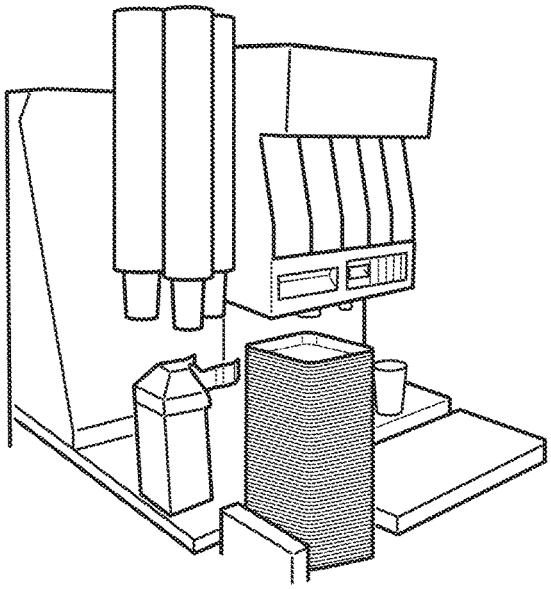
FIGS. 9-11 depict example macro-units in accordance with one or more embodiments of the disclosure.
Figure 10:
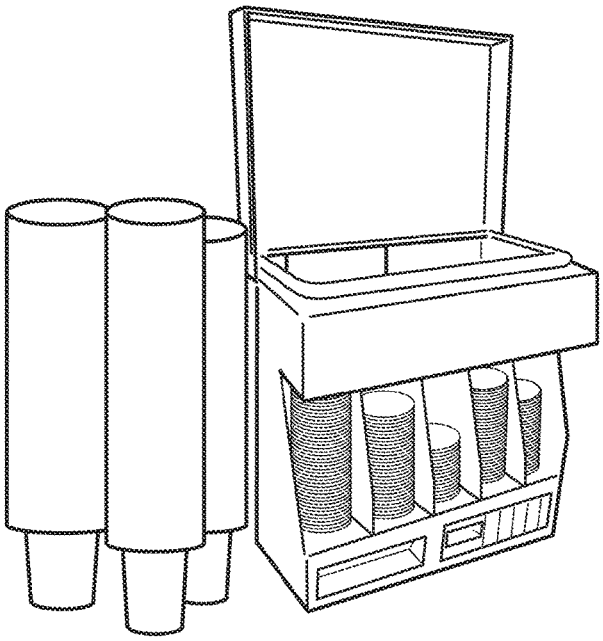
Figure 11:
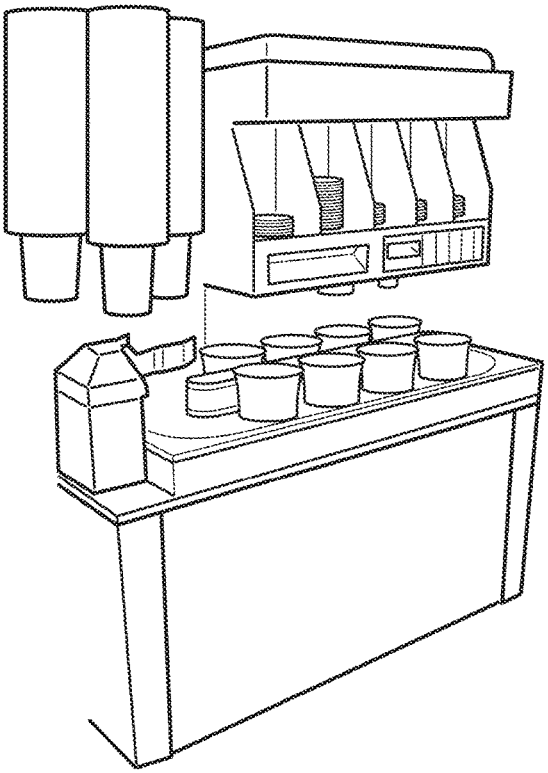

In some instances, the micro-unit 102 may be incorporated into the macro-unit 100 for incorporating micro-ingredient dispensing functionality into the macro-unit 100. The term "incorporated into" includes attaching, retrofitting, integrating, and/or collectively working together to produce a beverage. For example, the macro-unit 100 may include a post-mix beverage dispensing system, and the micro-unit 102 may include a retrofitted sidecar solution. A post-mix beverage dispensing system may deliver a beverage base (e.g., a macro-ingredient bag-in-box syrup) and a diluent (e.g., water or carbonated water) to a nozzle to provide a beverage. FIGS. 9-11 depict example post-mix beverage dispensing systems. Additional post-mix beverage systems are described in U.S. Pat. No. 6,053,359 and US patent publication No. 2015/0355810, which are herein incorporated by reference in their entirety.

In this manner, the macro-unit 100 may be a beverage dispenser that is capable of dispensing a beverage independently. In post-mix beverage dispensing systems, however, branded beverages may be undesirable diluted with the addition of the colors, flavors, and/or additives. Therefore, although the macro-unit 100 is capable of dispensing a beverage, it may be desirable to increase and improve the dispensing capabilities of the macro-unit 100 by incorporating micro-ingredient dispensing functionality into the macro-unit 100. This problem may be solved by integrating a micro-ingredient beverage dispensing system with the post-mix beverage dispensing system. In this manner, the micro-unit 102 may include a micro-ingredient beverage dispensing system that is in mechanical communication and/or electrical communication 104 with the macro-unit 100.

In some instances, the macro-unit 100 and the micro-unit 102 may be physically separated from each other, with the possible exception of one or more connections (e.g., conduits and/or wires) connecting the two for fluid communication with at least the nozzle. For example, the macro-unit 100 and the micro-unit 102 may be disposed side-by-side on a counter. In other instances, the micro-unit 102 may be disposed under a counter that the macro-unit 100 is located on. In yet other instances, the micro-unit 102 may be located in a backroom or elsewhere relative to the macro-unit 100 or vice versa. In still other instances, the macro-unit 100 and the micro-unit 102 may be integrally formed together as a single unit. The macro-unit 100 may be incorporated into the micro-unit 102, or the micro-unit 102 may be incorporated into the macro-unit 100. In any case, the macro-unit 100 and the micro-unit 102 may collectively form a hybrid dispensing system. The hybrid dispensing system may be a single unit or multiple units that collectively form the hybrid dispensing system. In certain embodiments, the macro-unit 100 and the micro-unit 102 may wirelessly communicate with each other. In yet other instances, the micro-unit 102 may be disposed within the macro-unit 100. For example, the macro-unit 100 may include an empty cavity in which the micro-unit 102 may be wholly or partially disposed. In some instances, the macro-unit 100 and the micro-unit 102 may include separate power sources. In other instances, the micro-unit 102 may be powered by the power source of the macro-unit 100 or draw power directly from the macro-unit 100.

Figure 2:
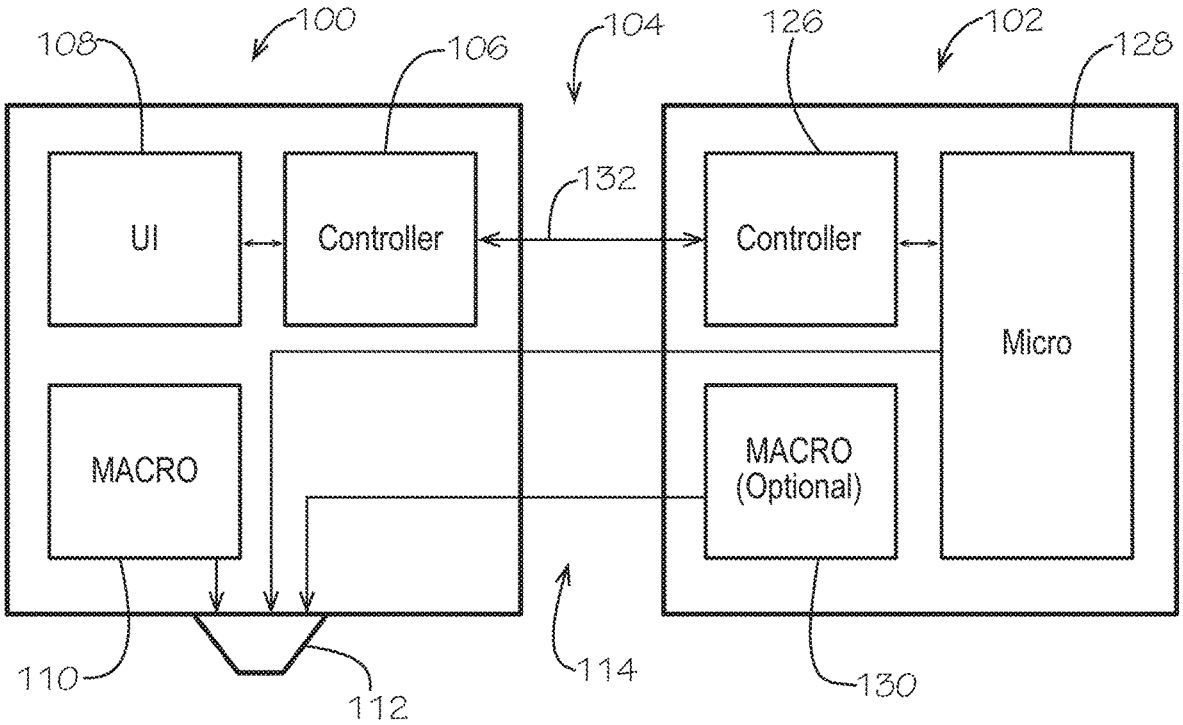
FIG. 2 depicts a system having micro-ingredient dispensing functionality in accordance with one or more embodiments of the disclosure.
Figure 2A:
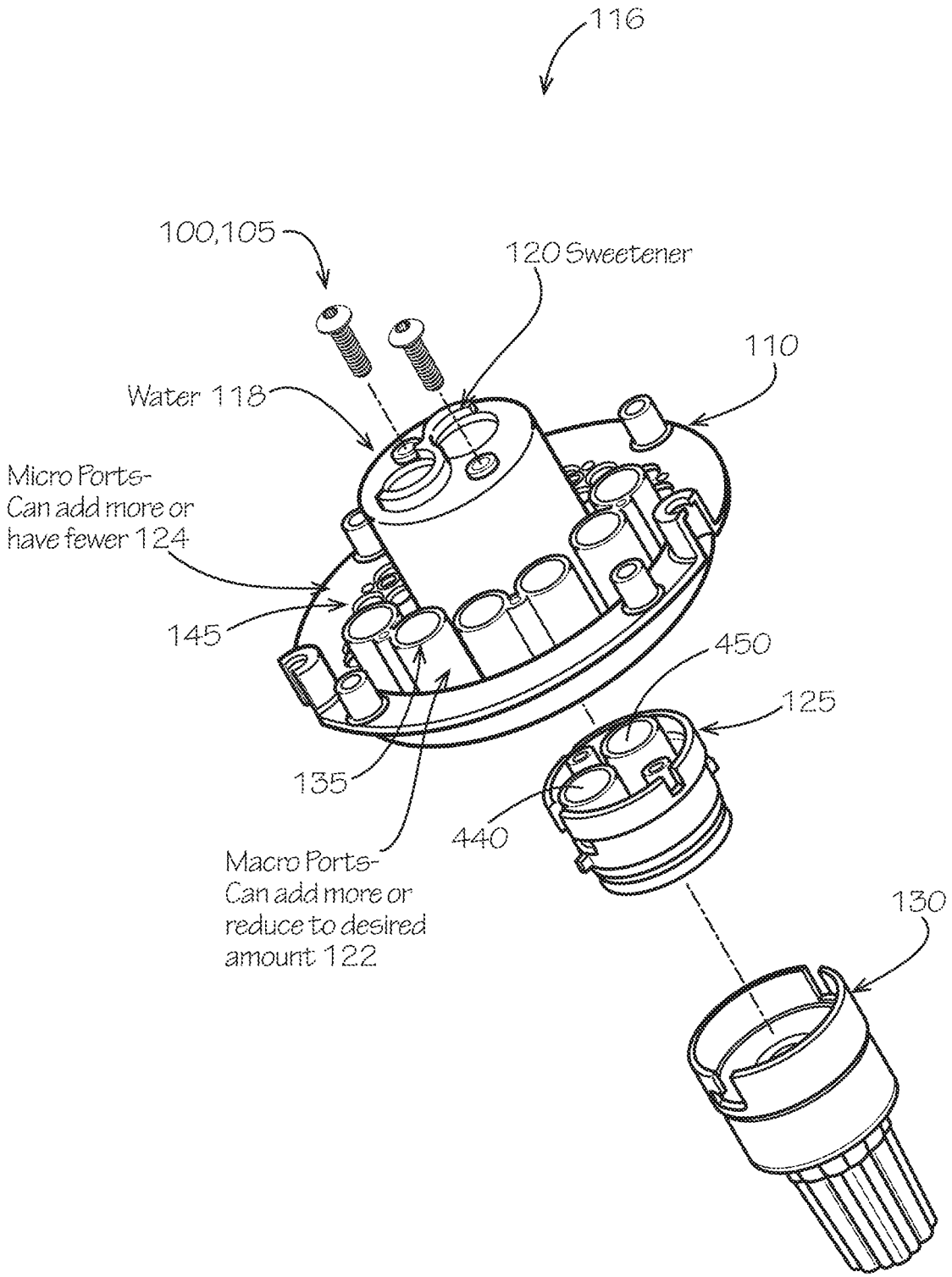
FIG. 2A depicts a nozzle in accordance with one or more embodiments of the disclosure.

As depicted in FIG. 2, the macro-unit 100 may include a controller 106, a user interface 108, at least one macro-ingredient 110, and a nozzle 112. The nozzle 112 may have any size, shape, or configuration. Any number of nozzles may be used. For example, in some systems a single nozzle may be present, while in other systems multiple nozzles may be used. In such instances, the various beverage components (macro/micro-ingredients) may be in communication with the nozzle 112 via one or more fluid conduits 114. In certain example embodiments, the nozzle described in U.S. provisional patent application Ser. No. 62/433,886, entitled "Dispensing Nozzle Assembly," PCT patent application Ser. No. PCT/US15/026657, entitled "Common Dispensing Nozzle Assembly," U.S. Pat. No. 7,866,509, entitled "Dispensing Nozzle Assembly," U.S. Pat. No. 7,578,415, entitled "Dispensing Nozzle Assembly," or U.S. patent publication No. 2015/0315006, which are herein incorporated by reference in their entirety, may be used. FIG. 2A depicts an example nozzle 116 that may be used herein. The nozzle 116 may include a number of ports for water 118, one or more sweeteners 120, macro-ingredients 122, and/or micro-ingredients 124. The ports may have any suitable size, shape, or configuration. Any number of ports may be used herein.

A user may interact with the user interface 108 of the macro-unit 100 in order to dispense a beverage from the macro-unit 100. In some instances, the user interface 108 may be a touch screen or the like. Any type of user interface may be used herein. The user interface 108 may have any size, shape, or configuration. In some instances, the user interface 108 may be similar to the user interfaces described in U.S. patent publication Nos. 2015/0082243, US 2015/0355810, or US 2016/0229678, which are herein incorporated by reference in their entirety.

The controller 106 in the macro-unit 100 may include any computing device capable of operating the various components of the macro-unit 100. As discussed in greater detail below, the controller 106 may include, among other things, a memory, a processor, and/or a database. In some instances, the controller described in U.S. Pat. No. 6,053,359 or US publication No. 2015/0355810, which are herein incorporated by reference in their entirely, may be used.

The micro-unit 102 may include a controller 126, a number of micro-ingredients 128, and at least one macro-ingredient 130. The macro-ingredient 130 may be a macro-ingredient sweetener source included in the micro-unit 102 for adding additional sweetness to flavored blends. The macro-ingredient 130 may include its own disposable pump, or additional pumps (e.g., peristaltic, CO2, controlled gear pump, etc.) may be incorporated into the micro-unit 102 for dispensing the macro-ingredient 130. In some instances, the macro-ingredient 130 in the micro-unit 102 may be omitted.

The controller 126 in the micro-unit 102 may include any computing device capable of operating the various components of the micro-unit 102. As discussed in greater detail below, the controller 126 may include, among other things, a memory, a processor, and/or a database. In some instances, the core dispense module (CDM) and associated lower level controller boards (e.g., micro-ingredient controller) described in PCT publication No. WO2015/103542, which is herein incorporated by reference in its entirely, may be used.

As discussed in greater detail below, the controller 106 of the macro-unit 100 may be in electrical communication 132 with the controller 126 of the micro-unit 102. The electrical communication 132 may be wired or wireless. The controllers 106, 126 may communication directly with each other or over a network. In some instances, the controllers 106, 126 may communicate with each other in order to dispense a beverage from the nozzle 112 of the macro-unit 100 using the macro-ingredient 110 from the macro-unit 100 and the micro-ingredients 128 from the micro-unit 102. The controllers 106, 126 may control the dispensing of other ingredients as well. In one example embodiment, a user may select a beverage displayed on the user interface 108 of the macro-unit 100, and the controller 106 of the macro-unit 100 may communicate with the controller 126 of the micro-unit 102 to control one or more pumps, valves, sensors, actuators, etc. in the macro-unit 100 and/or the micro-unit 102 to dispense a beverage from the nozzle 112.

In one example embodiment, the micro-unit 102 may receive a "pour" signal from the macro-unit 100, which may initiate a micro-ingredient dispensing sequence in the controller 126 of the micro-unit 102. In addition, the micro-unit 102 may receive a water flow signal from the macro-unit 100 through a flow switch, optical sensor, and/or other flow detection device, which also may initiate a micro-ingredient dispensing sequence in the micro-unit 102. The flow rate of the micro-ingredient dispensing may be based on a detected flow rate of the water dispensed from the macro-unit 100. In other instances, the controller 126 of the micro-unit 102 may optionally periodically check if the water is flowing through the nozzle 112 at the macro-unit 100. For example, the controller 126 of the micro-unit 102 may check every 25 ms or the like for a water flow reading. Any reference time may be used. The micro-unit 102 also may receive a signal from a valve (e.g., a solenoid valve) that corresponds to macro-ingredient 110 and/or a flavor order selected at the macro-unit 100. With all of this information, the controller 126 of the micro-unit 102 may determine/access a recipe from its database. Based on the recipe, the controller 126 of the micro-unit 102 may activate the dispensing the macro-ingredient 110, 130 and/or the micro-ingredient 128 through actuation of one or more valves, pumps, actuators, sensors, etc. If certain macro-ingredients 110, 130 and/or the micro-ingredients 128 are sold out, the controller 126 of the micro-unit 102 may provide an indication as such to the macro-unit 100, which may be disposed on the user interface 108.

The operations disclosed herein may be performed by the controller 126 of the micro-unit 102, the controller 106 of the macro-unit 100, or a combination thereof. For example, the controller 126 of the micro-unit 102 may communicate to the controller 106 of the macro-unit 100 that the flowrate of the macro-ingredient 110 should be adjusted. In turn, the controller 106 of the macro-unit 100 may adjust one or more pumps, actuators, valves, etc. to adjust the flow of the macro-ingredient 110. Alternatively, the controller 126 of the micro-unit 102 may adjust one or more pumps, actuators, valves, etc. to adjust the flow of the micro-ingredients 128 to accommodate the flow of the macro-ingredient 110 in order to properly execute a recipe. A common controller, remote or local, also may be used.

In some instances, the controllers 106, 126 may include dispenser control architecture similar to the dispenser control architecture described in PCT publication No. WO 2015/103542, which is herein incorporated by reference in its entirety. In addition, the controllers 106, 126 may include wireless capabilities such that a user can control the dispensing of a beverage remotely. For example, a user may operate a smart phone to control the dispensing of a beverage. In one example embodiment, the controllers 106, 126 may enable a user to dynamically adjust via the user interface 108 or a wireless device the ratios of a beverage as described in U.S. patent publication No. 2015/0046877, which is herein incorporated by reference in its entirety. Likewise, the controllers 106, 126 may include functionality for facilitating individualized user interaction with an electronic device, as described in U.S. patent publication No. 20155/0039776, which is herein incorporated by reference in its entirety.

Figure 3A:
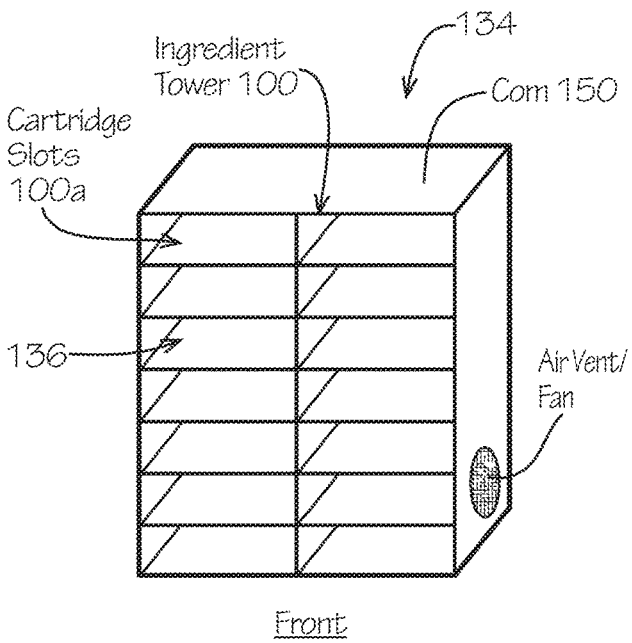
FIG. 3A depicts an ingredient tower in accordance with one or more embodiments of the disclosure.
Figure 3B:
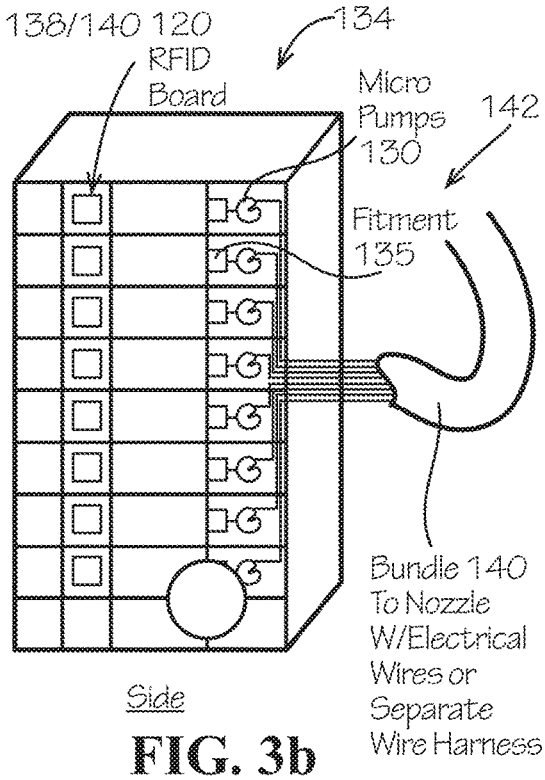
FIG. 3B depicts an ingredient tower in accordance with one or more embodiments of the disclosure.

As depicted in FIGS. 3A and 3B, the micro-ingredients 128 in the micro-unit 102 may be housed in a micro-ingredient tower 134, which may be disposed within the micro-unit 102. The micro-ingredients 128 may be stored in a number of micro-ingredient cartridges that are inserted into slots 136 in the micro-ingredient tower 134. U.S. Pat. No. 9,394,154, which is herein incorporated by reference in its entirety, describes one or more example micro-ingredient cartridges that may be used herein. The micro-ingredient cartridges may be any size, shape, or configuration. Any number of micro-ingredient cartridges may be used herein. In some instances, the micro-ingredient tower 134 may include an RFID reader 138, and each of the micro-ingredient cartridges may include an RFID tag 140 for inventory management. International patent publication No. WO 2015/148509, which is herein incorporated by reference in its entirety, describes various systems and methods for inventory management of the beverage components.

The micro-ingredient cartridges may be cardboard or paperboard cartons that enclose a pouch of micro-ingredients. The pouch can include a fitment for dispensing the micro-ingredients in the dispenser. The carton may be placed within a container that engages with and supports the fitment during installation of the carton in the dispenser—ensuing that the fitment is supported while a probe disposed in the dispenser is inserted into the fitment. In operation, a tear-away portion of the carton may be removed to reveal the fitment. The carton may be placed in the container and the fitment may be engaged in a landing. The carton and container may be inserted into the dispenser. In some instances, the micro-ingredients may be provided in cartridges that include a rigid housing that locks the fitment in place and houses the pouch, which is described in U.S. Pat. No. 8,333,224, which is herein incorporated by reference in its entirety.

In some instances, the micro-ingredient cartridges may include agitated micro-ingredient cartridges and/or static micro-ingredient cartridges. As discussed in greater detail below, the agitated micro-ingredient cartridges may be housed in an agitation tower, and the static micro-ingredient cartridges may be housed in a static tower. The agitation tower may include a number of agitated micro-ingredient cartridges staked thereon. The ingredients in the agitated micro-ingredient cartridges may require periodic agitation to maintain homogeneity. Likewise, the static micro-ingredient cartridges may include ingredients that may not require periodic agitation to maintain homogeneity. The cartridges themselves may be identical for the agitated micro-ingredient cartridges and static micro-ingredient cartridges. As described in International patent publication No. WO 2015/168293, which is herein incorporated by reference in its entirety, the agitation tower may include a chassis and agitation assembly for moving (i.e., agitating) the agitated micro-ingredient cartridges staked in the agitation tower in order to ensure the micro-ingredients within the agitated micro-ingredient cartridges are properly mixed. The static tower may include a similar configuration as the agitation tower, except that the static tower may not move. That is, the static tower may include the chassis without the agitation assembly. In this manner, the static tower may not agitate the static micro-ingredient cartridges staked thereon. The agitation tower and the static tower may be disposed side-by-side.

The micro-ingredient cartridges may be in communication with the nozzle 112 via one or more pumps, conduits, and/or wires 142. In some instances, the conduits and wires may be bundled together 142. The micro-ingredient tower, micro-ingredient cartridges, pumps, and conduits may have any suitable size, shape, or configuration.

Figure 17:
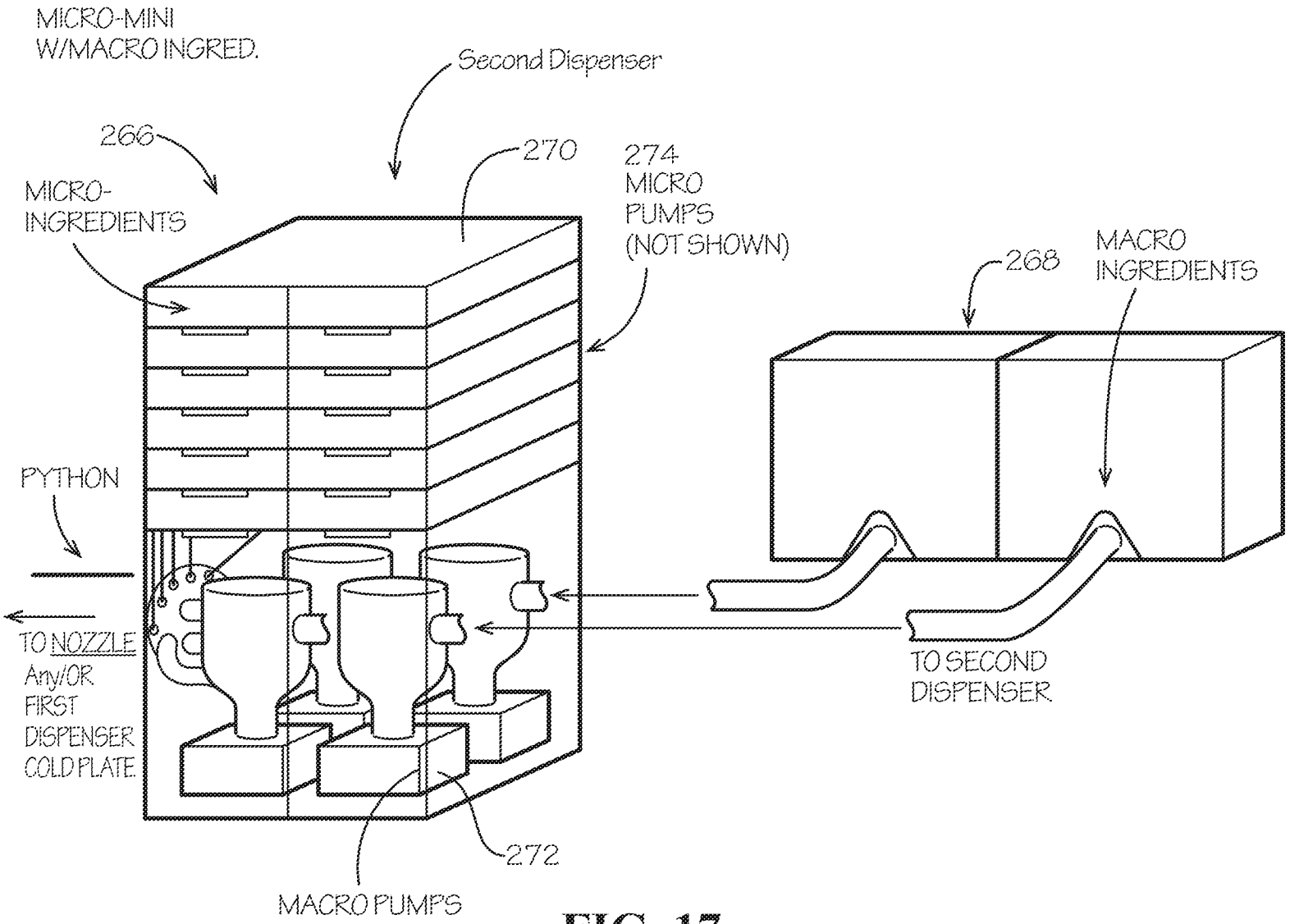
FIG. 17 depicts a micro-unit including both micro and macro ingredients in accordance with one or more embodiments of the disclosure.

FIG. 17 depicts a beverage dispenser in which the micro-unit 102 includes both micro-ingredients 266 and macro-ingredients 268 for delivery. For example, the micro-tower 270 further includes macro-pumps 272 (such as control gear pumps) to deliver the macro-ingredients 268 to the nozzle or macro-unit cold plate. The micro-tower 270 also may include micro-pumps 274 to deliver the micro-ingredients 266 to the nozzle. In this manner, the micro-unit may use different pumps but the same controls to deliver the macro and micro ingredient. In some instances, the macro-ingredients may be delivered to the cold plate or other refrigeration system of the macro-unit. This provides additional beverage choices not available in a legacy or legacy plus system.

Figure 3C:
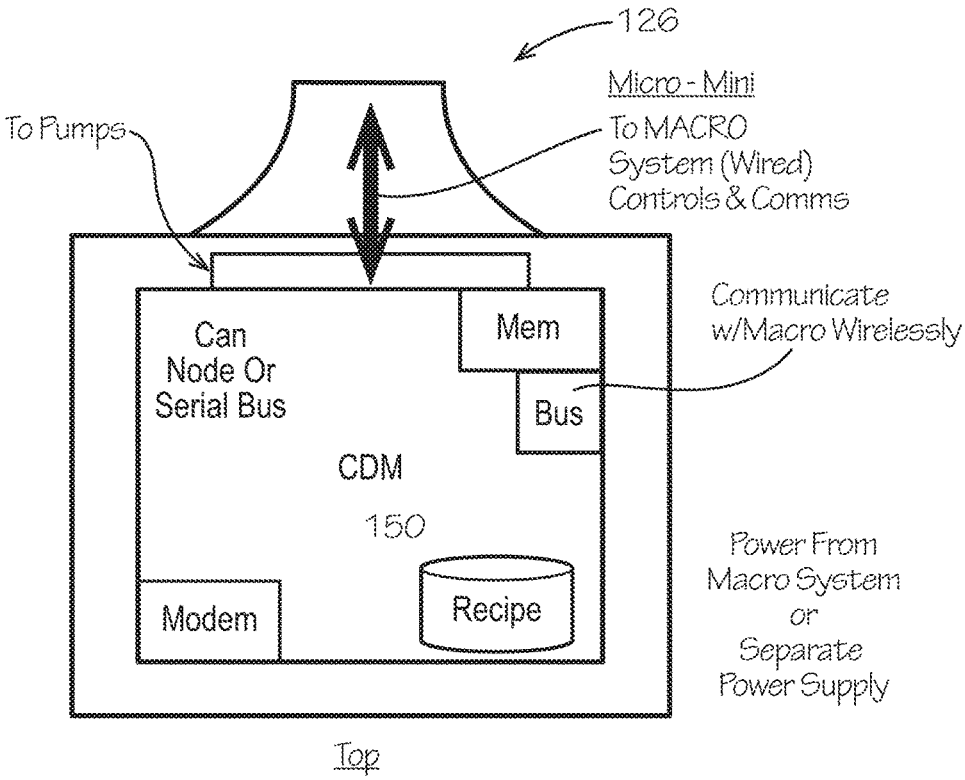
FIG. 3C depicts an example controller architecture in accordance with one or more embodiments of the disclosure.

FIG. 3C depicts an example controller 126 of the micro-unit 102. The various components of the controller 126 may communicate via a serial bus. The controller 126 may include a memory, a modem, a database, and a communication interface for communicating with the controller 106 of the macro-unit 100. The controller 126 may be wired to the macro-unit 100 or communicate wirelessly with the macro-unit 100. The controller 126 may include one or more modules for controlling the pumps, valves, sensors, etc. of the micro-unit 102. The database may include beverage recipes or the like. The macro-unit 100 may include a similar controller. The controller 126 in the micro-unit 102 may receive signals and/or send signals to the controller 106 in the macro-unit 100 in order to operate the various components of the dispensers to dispense a beverage.

Figure 5:
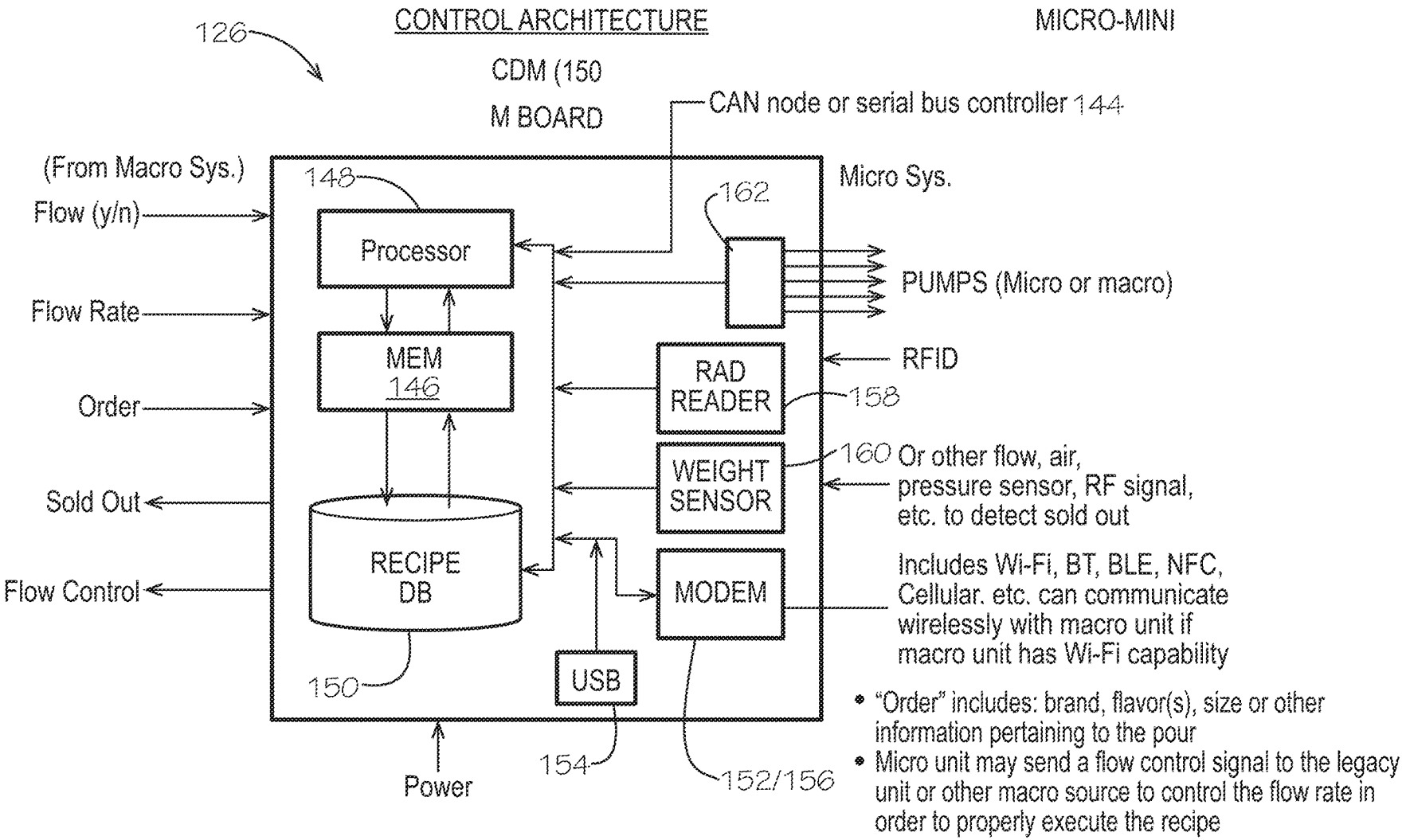
FIG. 5 depicts a controller in accordance with one or more embodiments of the disclosure.

FIG. 5 depicts a more detailed view of the controller 126 in FIG. 3C. The various components of the controller 126 may communicate via a serial bus or CAN bus 144. Any communication means may be used. The controller 126 may include a memory 146, a processor 148, a database 150, a modem interface 152, a USB interface 154, a communication interface 156, a RFID module 158, a sensor module 160, and a pump module 162. The controller 126 may include additional or fewer components. The macro-unit 100 may include a similar controller. The modem interface 152, 156 may include Wi-Fi, BT, BLE, NFC, Cellular, or other communication capabilities. In some instances, the modem 152, 156 may communicate wirelessly with the macro-unit 100 if the macro-unit 100 also includes wireless capabilities. The modem 152, 156 may communication with other computing devices over a network. For example, the modem 152, 156 may enable the micro-unit 102 to communication with a point-of-sale device, the user interface 108 of the macro-unit 100, inventory management devices, customer devices (e.g., smart phones or the like), and/or a server network. In this manner, the micro-unit 102 may provide data to a remote computing device for analysis. In addition, the micro-unit 102 may be controlled and/or updated remotely.

The sensor module 160 may receive signals from one or more sensors located in the micro-unit 102 and/or the macro-unit 100. For example, the macro-unit 100 and/or the micro-unit 102 may include flowmeters, pressure sensors, weight sensors, etc. The reading from the various sensors may be used to control the dispensing of the beverage and/or manage the inventory of the beverage ingredients in the micro-unit 102 and/or the macro-unit 100. Any number of flow controls and calibration methods may be used.

The controller 126 may include a number of input and output signals. In some instances, the controller 126 of the micro-unit 102 may receive and/or send signals to and from the controller 106 of the macro-unit 100. In some instances, the controller 126 of the micro-unit 102 may receive/send signals to various components in the micro-unit 102 and/or the macro-unit 100. For example, the controller 126 may receive a signal that the macro-ingredient 110 is flowing, a flow rate of the macro-ingredient 110, and/or an order. An order may include a brand selection, a size selection, a color selection, a flavor selection, and/or an additive selection. The controller 126 may provide flow control signals to the macro-unit 100 and/or other macro-ingredient sources to control the flow rate of the macro-ingredient 110, 130 to properly execute the beverage recipe stored in the database 150. In addition, the controller 126 may provide flow control signals for the micro-ingredients 128. For example, the pump module 162 may control actuation of the pumps in the micro-unit 102 to control the flow of the micro-ingredients 128 to execute properly the recipe stored in the database 150. The pump module 162 also may control the actuation of one or more pumps associate with the macro-ingredients 110 in the macro-unit 100.

Figure 4:
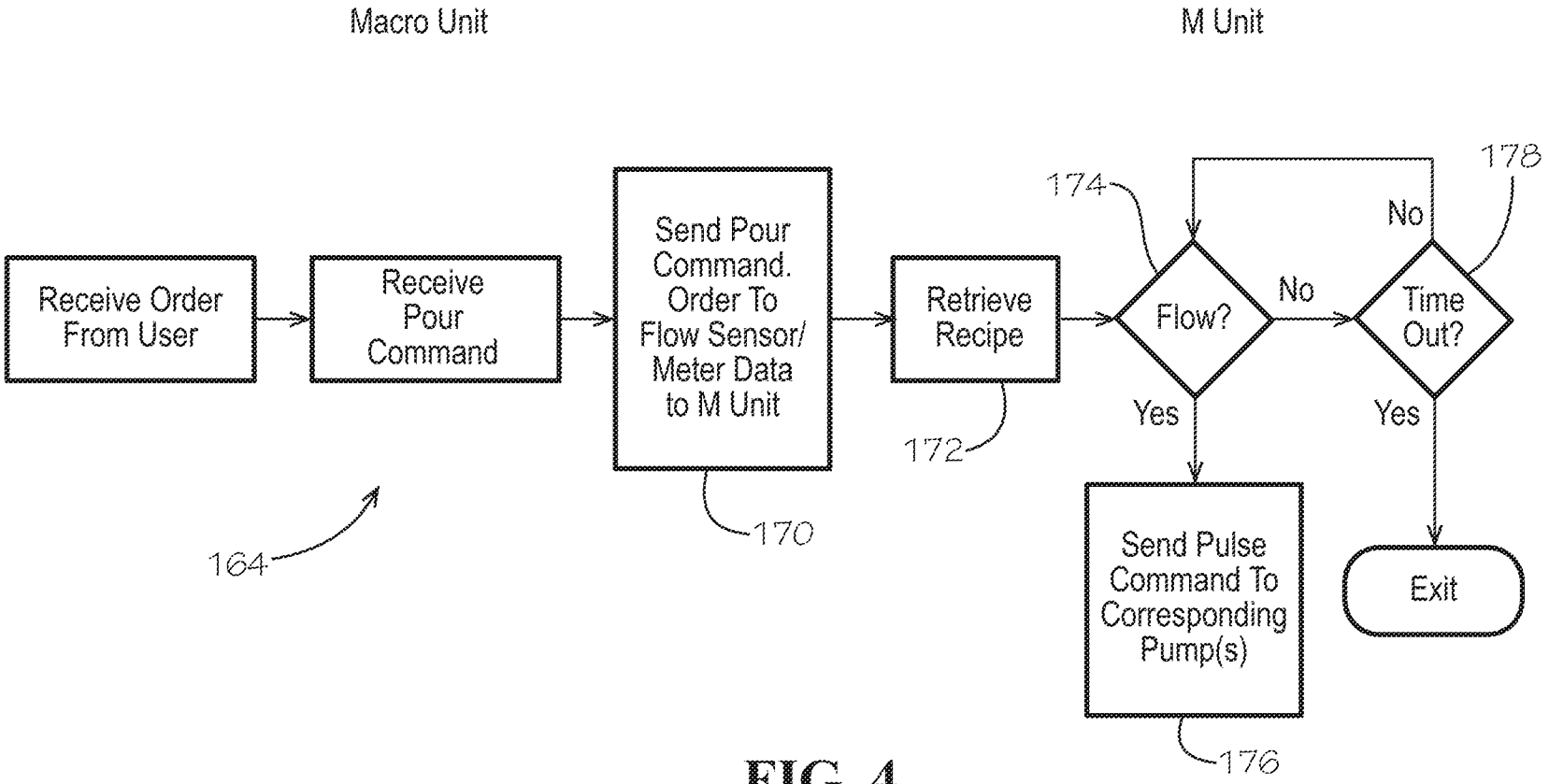
FIG. 4 is a flow diagram depicting an illustrative method for dispensing a beverage in accordance with one or more embodiments of the disclosure.

FIG. 4 depicts an example flow diagram 164 of a method for dispensing a beverage using the macro-unit 100 and the micro-unit 102 together. As noted above, the macro-unit 100 may be a macro-ingredient unit, and the second beverage dispenser 102 may be a micro-ingredient unit. The operations shown in FIG. 4 may be performed in the controller 106 of the macro-unit 100, the controller 126 of the micro-unit 102, or a combination thereof. For example, a user may input an order 166 at the user interface 108 of the macro-unit 100. The order may be received in other ways, including wirelessly and/or over the internet. In response to the order, the controller 106 of the macro-unit 100 may receive a pour command 168. Next, at block 170, the controller 106 of the macro-unit 100 may send the order, the pour command, and/or sensor data associated with the flow of the macro-ingredient to the controller 126 of the micro-unit 102. The controller 126 of the micro-unit 102 may then retrieve a recipe 172 from its database. Next, at block 174, the controller 126 of the micro-unit 102 may determine if and/or which micro-ingredients 128 should be dispensed. In such instances, the controller 126 of the micro-unit 102 may send a signal 176 to one or more actuators (pumps) and/or valves to initiate dispensing of the micro-ingredient(s). The controller 126 of the micro-unit 102 then may determine if the flow of micro-ingredients should be continued. If yes, then the flow of micro-ingredients continues. If no, then the process determines at block 178 if a timeout is appropriate. If yes, then the process ends. If no, then the process returns to flow determination. Other method steps may be used herein in any order.

Figure 6A:
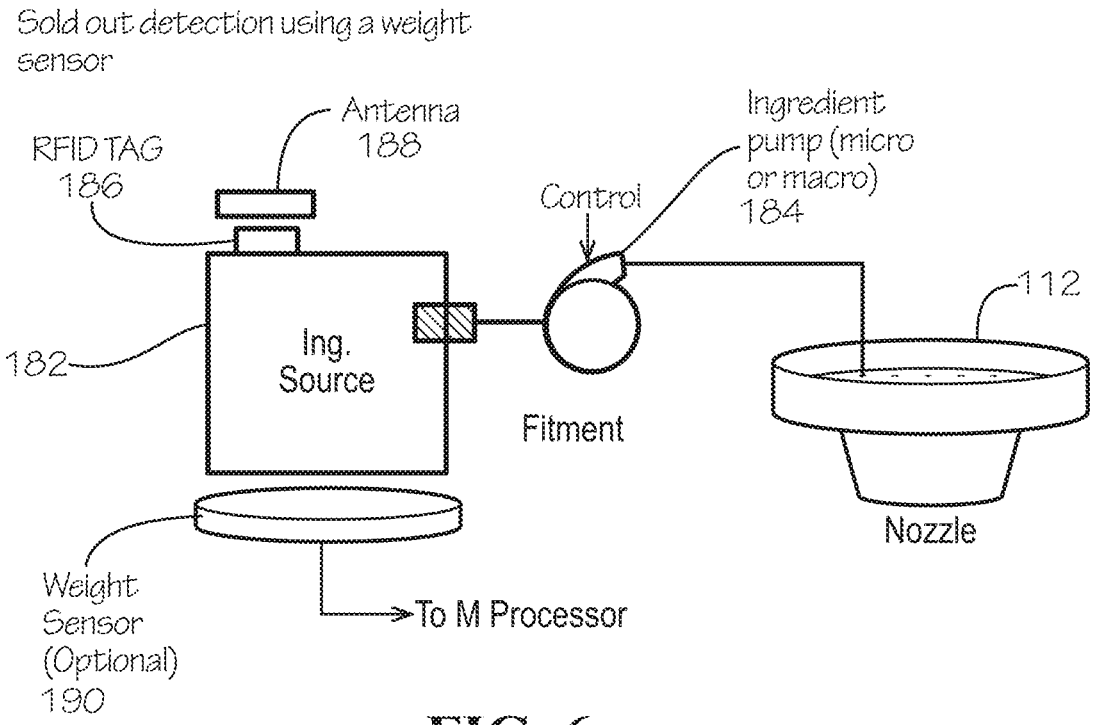
FIG. 6A depicts a subsystem to determine if an ingredient is sold-out in accordance with one or more embodiments of the disclosure.

FIG. 6A depicts a subsystem that may be disposed in the macro-unit 100 and/or the micro-unit 102 to determine whether an ingredient is sold-out. The ingredient may be disposed within a cartridge or container. A conduit 180 may connect the container 182 to the nozzle 112. A pump 184 disposed along the conduit 180 may pump the ingredient from the container 182 to the nozzle 112. The container 182 may include an RFID tag 186 attached thereto, and the dispensing unit may include an RFID reader 188 in communication one or both of the controllers 106, 126. The container 182 may be disposed on top of a weight sensor 190. The weight sensor 190 also may be in communication with one or both of the controllers 106, 126. In this manner, based on the reading of the RFID tag 186 by the RFID reader 188 and the weight of the container 182, one or both of the controllers 106, 126 may be able to determine the amount of ingredient remaining in the container 182. If the weight of the container 182 indicates that the ingredient is low or empty, one or both of the controllers 106, 126 may provide an indication to the other subsystems of the dispensing unit that the ingredient (and any beverage including the ingredient) is sold-out.

Figure 6B:
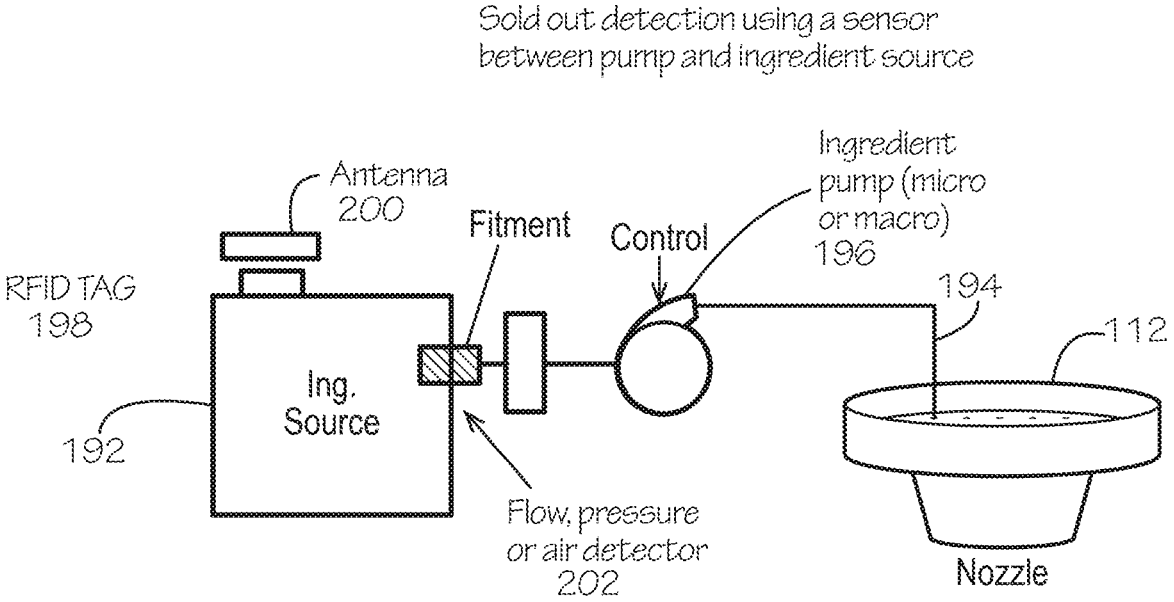
FIG. 6B depicts a subsystem to determine if an ingredient is sold-out in accordance with one or more embodiments of the disclosure.

FIG. 6B depicts another example subsystem that may be disposed in the macro-unit 100 and/or the micro-unit 102 to determine whether an ingredient is sold-out. The ingredient may be disposed within a container 192. A conduit 194 may connect the container 192 to the nozzle 112. A pump 196 disposed along the conduit 194 may pump the ingredient from the container 192 to the nozzle 112. The container 192 may include an RFID tag 198 attached thereto, and the dispensing unit may include an RFID reader 200 in communication one or both of the controllers 106, 126. A sensor 202 may be disposed between the container 192 and the pump 196. The sensor 202 may be a flowmeter, a pressure sensor, and/or an air detector. The sensor 202 may be in communication with one or both of the controllers 106, 126, which may be in communication with the pump 196. In this manner, based on the reading of the sensor 202, one or both of the controllers 106, 126 may be able to determine the amount of ingredient remaining in the container 192. If sensor 202 indicates that the ingredient is low or empty, one or both of the controllers 106, 126 may provide an indication to the other subsystems of the dispensing unit that the ingredient (and any beverage including the ingredient) is sold-out.

Figure 7:
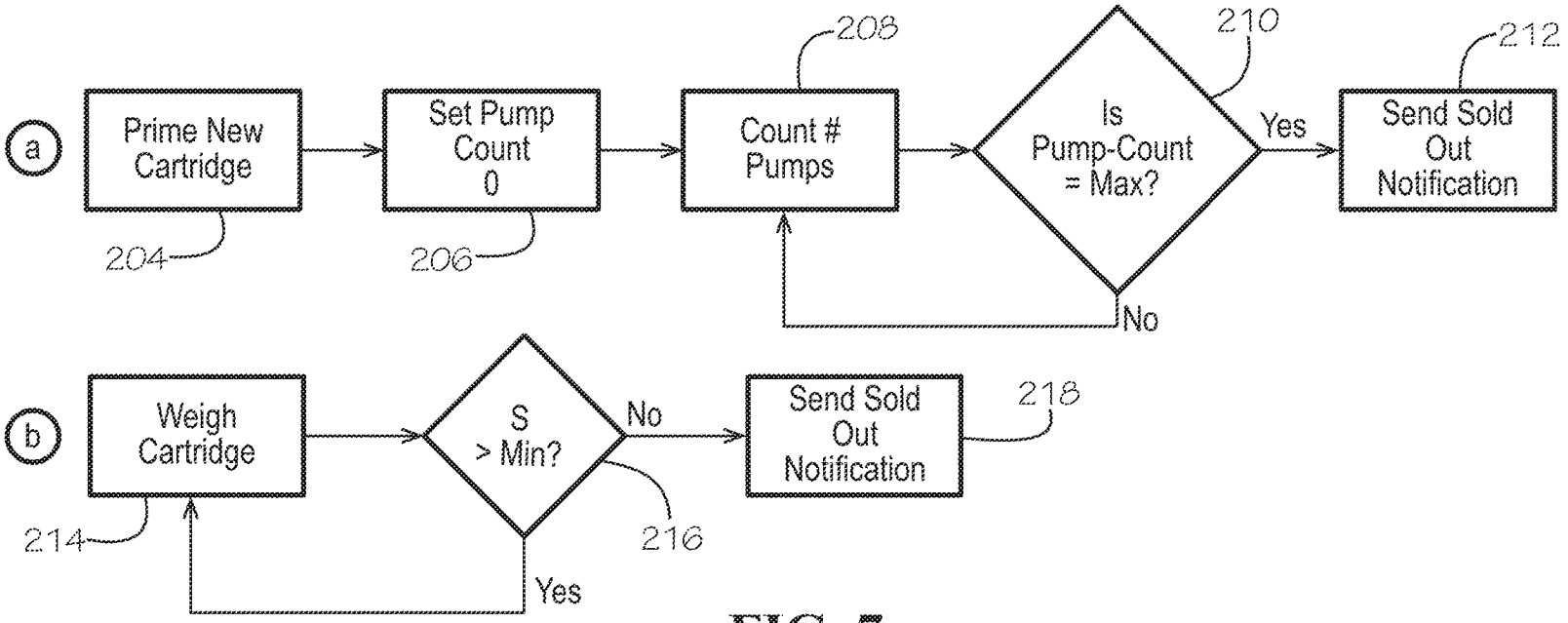
FIG. 7A is a flow diagram depicting an illustrative method for determining if an ingredient is sold-out in accordance with one or more embodiments of the disclosure.
FIG. 7B is a flow diagram depicting an illustrative method for determining if an ingredient is sold-out in accordance with one or more embodiments of the disclosure.

FIGS. 7A and 7B depict example flow diagrams of methods for determining if a product is sold-out. The methods may be completed by one or both of the controllers 106, 126. In FIG. 7A, a new ingredient cartridge or container may be primed at block 204. Next, at block 206, a pump count may be set to zero. The number of pumps may then be counted at block 208. The process may then determine, at block 210, if the number of pumps equals (or is near) the maximum number of pumps that the cartridge or container is capable of producing. If the maximum number of pumps has not been reached, then the process goes back to determine the number of pumps. On the other hand, if the maximum number of pumps is reached, the dispensing unit may provide an indication at block 212 to the other subsystems of the dispensing unit that the ingredient (and any beverage including the ingredient) is sold-out. The process in FIG. 7A corresponds to the system in FIG. 6B.

In FIG. 7B, the cartridge or container may be weighted at block 214. One or both of the controllers 106, 126 may include information regarding the minimum weight of the cartridge or container. Based on this information, one or both of the controllers 106, 126 may determine at block 216 if the cartridge or container includes a minimum weight (or close thereto). If no, the dispensing unit may provide an indication to the other subsystems of the dispensing unit that the ingredient (and any beverage including the ingredient) is sold-out at block 218. If yes, the cartridge or container may be weighed again. The process in FIG. 7B corresponds to the system in FIG. 6A. Other method steps may be used herein in any order.

Figure 8:
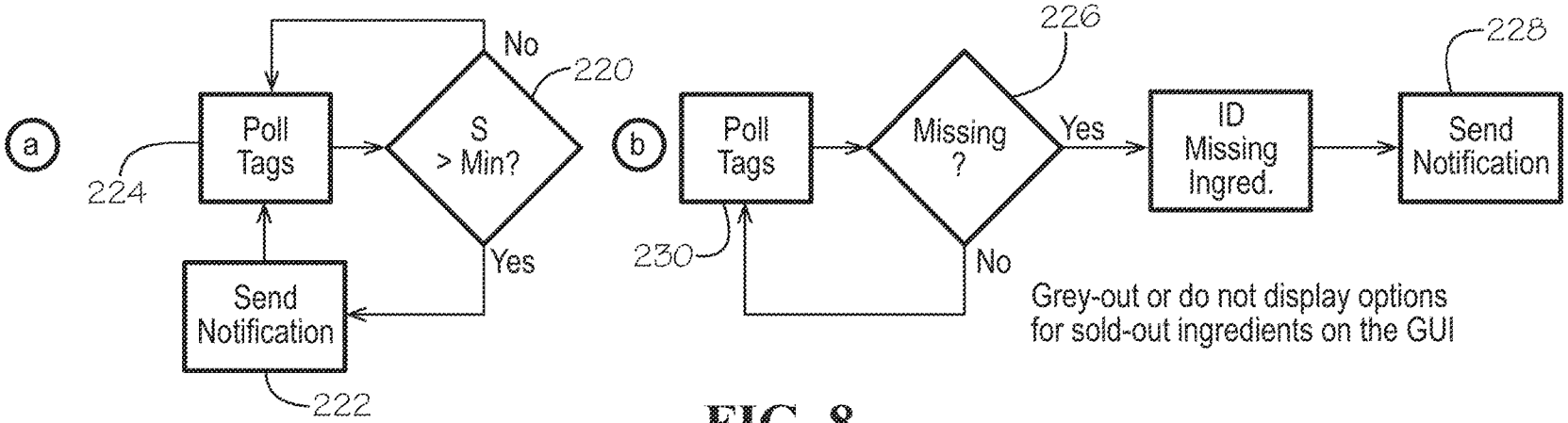
FIG. 8A is a flow diagram depicting an illustrative method for inventory management in accordance with one or more embodiments of the disclosure.
FIG. 8B is a flow diagram depicting an illustrative method for inventory management in accordance with one or more embodiments of the disclosure.

FIGS. 8A and 8B depict example flow diagrams of methods for determining if a cartridge or container is missing from one or both of the dispensing units. For example, as noted above, some or all of the cartridges or containers may include RFID tags. In FIG. 8A, a sensor may detect if the RFID tag is missing at block 220, which indicates that the cartridge or container is missing. If yes, at block 222, the dispensing unit may provide an indication to the other subsystems of the dispensing unit that the ingredient (and any beverage including the ingredient) is sold-out. The dispensing unit also may provide a notification to an inventory management system. If no, the process may keep checking for the RFID tag at block 224. In FIG. 8B, a sensor may detect if the RFID tag is missing at block 226, which indicates that the cartridge or container is missing. If yes, the dispensing unit may provide an indication to the other subsystems of the dispensing unit that the ingredient (and any beverage including the ingredient) is sold-out at block 228. The dispensing unit also may provide a notification to an inventory management system. If no, the process may keep checking for the RFID tag at block 230. Other method steps may be used herein in any order.

Macro-ingredient units, such as legacy and legacy plus post-mix beverage dispensers, mix various ingredients with water to form a finished beverage. The ratio of the ingredients to the water is critical to the quality of the beverage. Mechanical flow controls are typically used to control the flowrate of water, carbonated water, and macro-ingredients (with ingredient to water ratios typically of about 4:1 to 10:1). For example, a setscrew may be adjusted to control the flows. Mechanical flow controls may not provide electrical feedback indicating flowrates. Therefore, methods are disclosed herein to calibrate the dosing of micro-ingredient to the macro-ingredients. The methods below are used to determine the flowrate of the macro-ingredients so the micro-ingredient controller can determine the correct dosing rate of micro-ingredients for each beverage.

Figure 12:
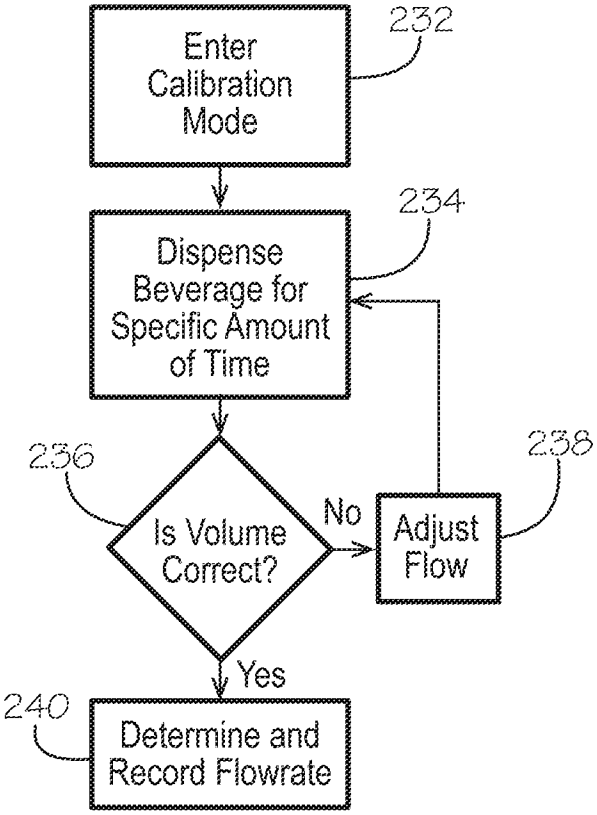

In a first calibration method, as depicted in FIG. 12, the macro-unit may enter a calibration mode at block 232. For example, a technician may enter a calibration mode on the user interface. Next, at block 234, a beverage may be dispensed for a specific period of time into a volume measuring device. For example, a 500 ml graduated cylinder may be placed under the nozzle and Coca-Cola may be dispensed for a period of five seconds. If the volume dispensed is not within a predefined parameter, as determined at block 236, then the flowrates of the beverage components may be adjusted at block 238 and retested at block 234. If, on the other hand, the volume dispensed is within the predefined parameter, the volume may be recorded and one or both controllers may calculate the flowrate at block 240. In some instances, the volume can be manually entered into the system via the user interface. This process may be repeated multiple times and the average volumes and flowrates recorded. In addition, this process may be performed for other beverages, such as Diet Coke, Sprite, etc. The calculated flowrates for each beverage may be used by the one or both of the dispenser controllers to determine the dosing rate for the micro-ingredient when the beverage is dispensed. Other method steps may be used herein in any order.

Figure 13:
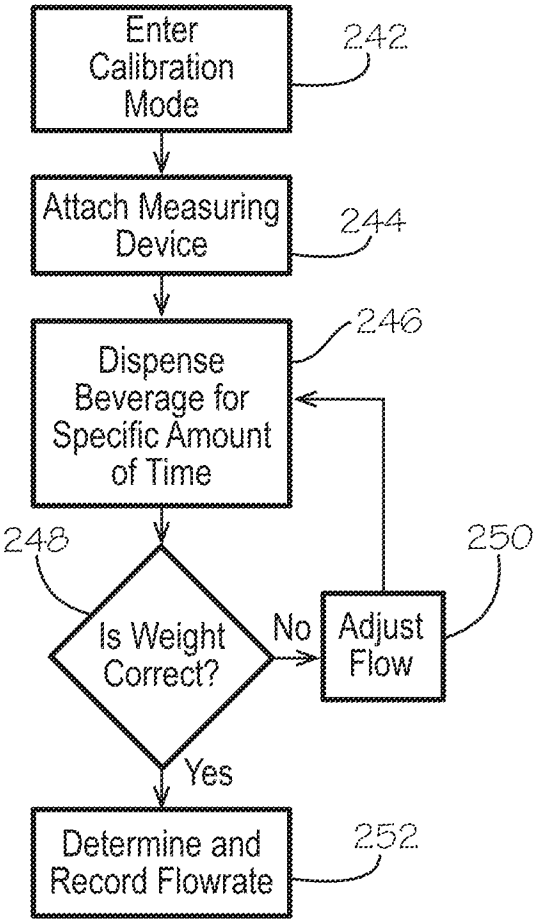

In a second calibration method, as depicted in FIG. 13, the macro-unit may enter a calibration mode at block 242. For example, a technician may enter a calibration mode on the user interface. Next, at block 244, a measuring device may be attached to the macro-unit with the empty measuring device placed under the nozzle. For example, a calibration cup may be plugged into a USB port or the like and the cup placed under the nozzle. At block 246, a beverage may be dispensed for a specific period of time into the measuring device. For example, the calibration cup may be placed under the nozzle and Coca-Cola may be dispensed for a period of five seconds. The measuring device may measure the weight of the fluid within the cup and determine the volume dispensed. If the volume dispensed is not within a predetermined parameter, as determined at block 248, the water and the macro-ingredient ratio may be adjusted at block 250 and retested at block 246. For example, if the volume dispensed is not between 370-480 ml (2.5 oz/sec-3.25 oz/sec), the water and macro-syrup may be adjusted and retested. If, on the other hand, the volume dispensed is within the predefined parameter, the volume may be recorded and one or both controllers may calculate the flowrate at block 252. In some instances, the volume can be manually entered into the system via the user interface. This process may be repeated multiple times and the average volumes and flowrates recorded. In addition, this process may be performed for other beverages, such as Diet Coke, Sprite, etc. The calculated flowrates for each beverage may be used by the one or both of the dispenser controllers to determine the dosing rate for the micro-ingredient when the beverage is dispensed. Other method steps may be used herein in any order.

Figure 14:
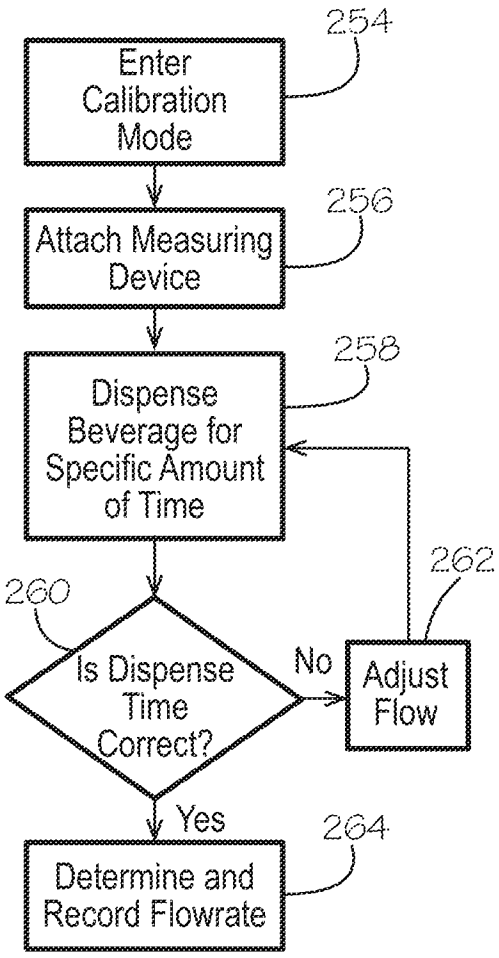
FIGS. 12-14 are flow diagrams depicting an illustrative method for calibration in accordance with one or more embodiments of the disclosure.

In a third calibration method, as depicted in FIG. 14, the macro-unit may enter a calibration mode at block 254. For example, a technician may enter a calibration mode on the user interface. Next, at block 256, a measuring device may be attached to the macro-unit with the empty measuring device placed under the nozzle. For example, a calibration cup may be plugged into a USB port or the like and the cup placed under the nozzle. A beverage may be dispensed until the measuring device is full at block 258. For example, the nozzle may dispense 400 ml of Coca-Cola. If the dispense time is not within a predetermined parameter, as determined at block 260, the flow ratio of the water and macro-ingredient may be adjusted at block 262 and retested at block 258. For example, if the dispensing time is not between 4.2-5.4 sec (2.5 oz/sec-3.25 oz/sec finished beverage), the water and macro-syrup may be adjusted and retested. If, on the other hand, the dispensing time is within the predefined parameter, the time may be recorded and one or both controllers may calculate the flowrate at block 264. In some instances, the time can be manually entered into the system via the user interface. This process may be repeated multiple times and the average times and flowrates recorded. In addition, this process may be performed for other beverages, such as Diet Coke, Sprite, etc. The calculated flowrates for each beverage may be used by the one or both of the dispenser controllers to determine the dosing rate for the micro-ingredient when the beverage is dispensed. Other method steps may be used herein in any order.

Figure 16:
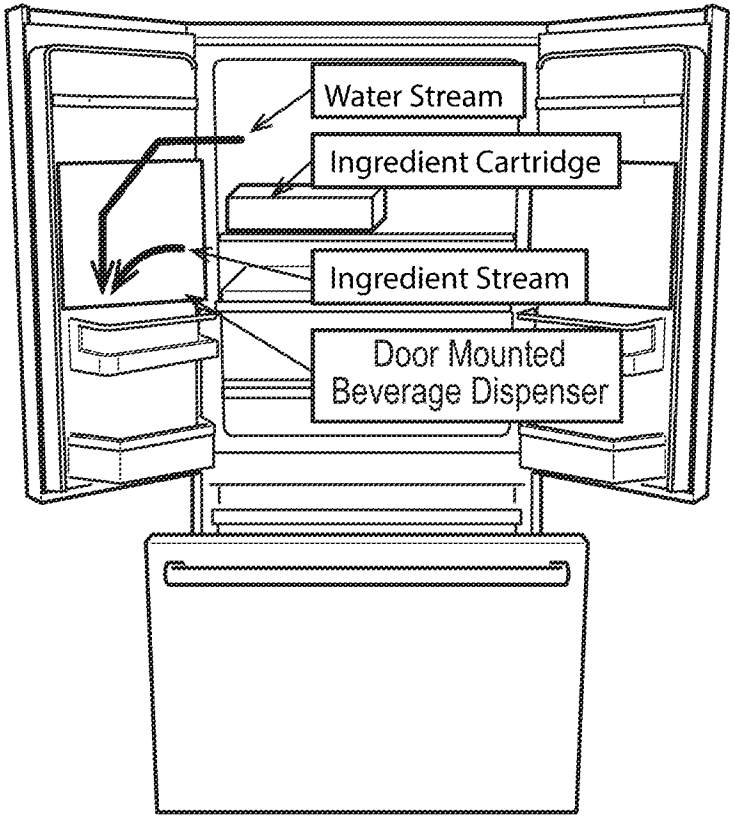
FIGS. 15 and 16 depict a system having micro-ingredients dispensing functionality in a household refrigerator in accordance with one or more embodiments of the disclosure.
Figure 15:
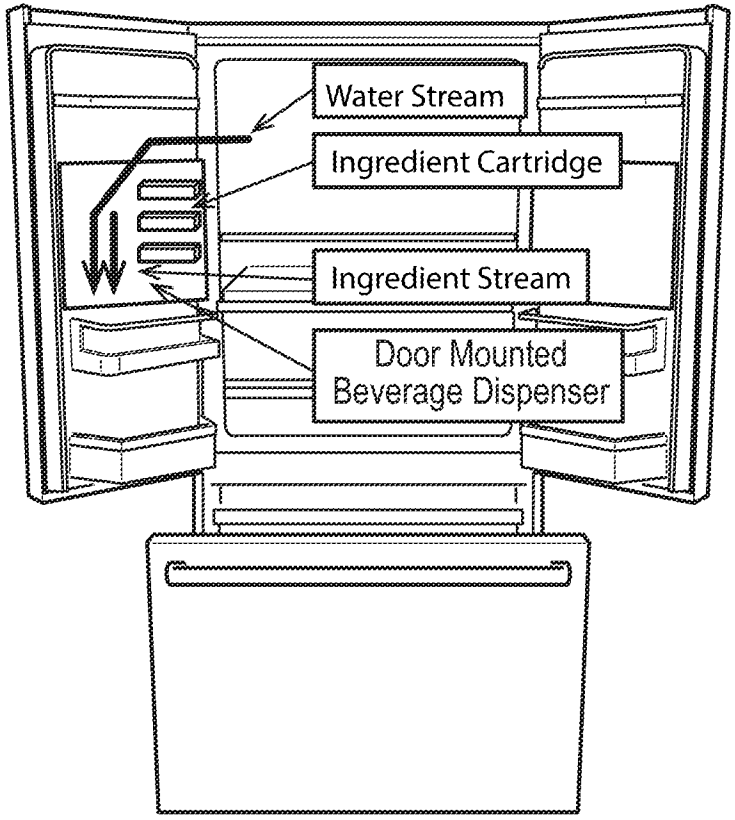

In another example embodiment, as depicted in FIGS. 15 and 16, the first beverage dispenser may be embedded in a refrigerator. For example, the first beverage dispenser may be located in the door of a household refrigerator. In this manner, the first beverage dispenser may be a typical filtered water dispenser. In such a system, the second beverage dispenser may be a compact micro-dosing dispenser that fits within the refrigerator. The micro-ingredient unit may fit within the door of the refrigerator or be disposed within the cabinet of the refrigerator. Similar to the micro-ingredient unit discussed above, the micro-ingredient unit disposed in the household refrigerator may include a controller and a number of micro-ingredient cartridges, which may be arraigned in a tower. The micro-ingredient cartridges may be in communication with the nozzle of the water filter or have a separate nozzle disposed adjacent to the filtered water nozzle. In other instances, a separate source of water may be disposed within the refrigerator and in fluid communication with the micro-ingredient cartridge nozzle. As a result, a user can dispense a beverage from their home at their refrigerator without having to go to the store. The various micro-ingredients may mix at the nozzle with the filtered water as the beverage is being dispensed.

FIGS. 18-24 depict various beverage dispenser configurations that may be used herein. For example, the beverage dispenser configurations disclosed in FIGS. 18-24 may be employed to dispense a beverage using the macro-unit 100, the micro-unit 102, or a combination thereof. That is, portions of the beverage dispensers depicted in FIGS. 18-24 may be incorporated into and/or formed by the macro-unit 100, the micro-unit 102, or a combination thereof. In other instances, the beverage dispenser configurations disclosed in FIGS. 18-24 may be stand along hybrid beverage dispensers that includes both macro-ingredient and micro-ingredient dispensing functionality.

Figure 18:
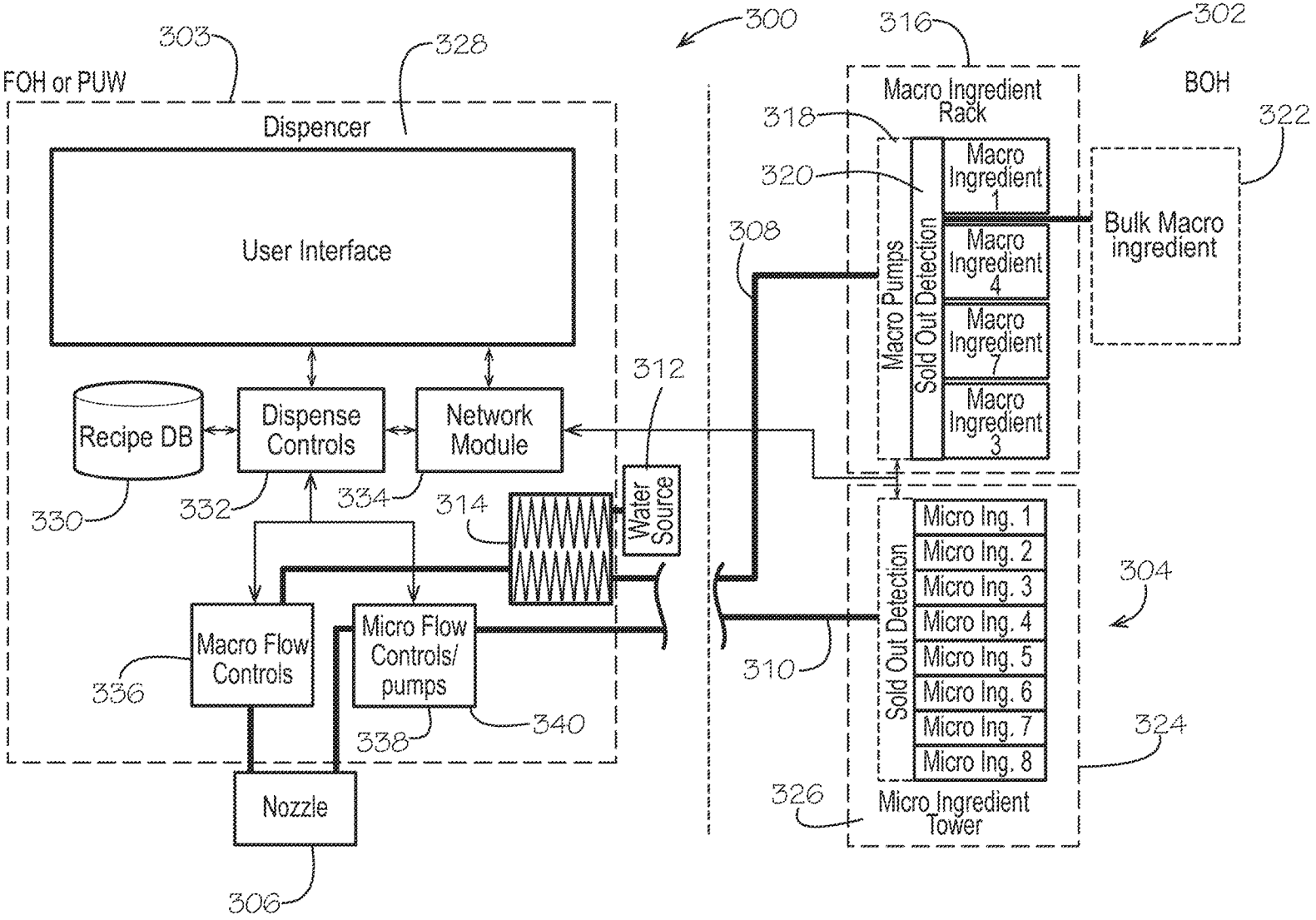
FIG. 18 depicts an example beverage dispenser in accordance with one or more embodiments of the disclosure.

As depicted in FIG. 18, a beverage dispensing system 300 may include a number of macro-ingredients 302 and a number of micro-ingredients 304 in fluid communication with a nozzle 306. For example, the macro-ingredients 302 may be in fluid communication with the nozzle 306 via a macro-conduit 308, and the micro-ingredients 304 may be in fluid communication with the nozzle 306 via a micro-conduit 310. The macro-ingredients 304 may be disposed in macro-ingredient containers, and the micro-ingredients 304 may be disposed in micro-ingredient cartridges. The containers and the cartridges may be any suitable size, shape, or configuration.

In addition, a water source 312 may be in fluid communication with the nozzle 306. In some instances, an ice bath 314 or other refrigeration or heating/cooling device, such as a heat exchanger, may be disposed between the water source 312 and the nozzle 306 and/or along the macro-conduit 308 for controlling a temperature of the beverage.

The macro-ingredients 302 may be housed in a macro-ingredient rack 316. That is, the macro-ingredient containers may be disposed on the macro-ingredient rack 316. The macro-ingredient rack 316 may include macro-pumps 318 positioned thereon or adjacent thereto for pumping the macro-ingredients 302 and one or more macro-sensors 320 (also known as sold out sensors) for detecting the level of each of the macro-ingredients 302 in the containers. As discussed in greater detail below, in some instances, a bulk macro-ingredient 322 may also be in communication with the macro-pumps 318. The bulk macro-ingredient 322 may be stored in a bulk macro-ingredient container. The bulk macro-ingredient 322 (e.g., a syrup macro-ingredient or the like having a storage container greater than about 5 gallons) may also be connected to the macro-pumps 318 via a conduit 362.

Similarly, the micro-ingredients 304 may be housed in a micro-ingredient tower 324. That is, the micro-ingredient cartridges may be disposed on the micro-ingredients tower 324. The micro-ingredient tower 324 may include one or more micro-sensors 326 (also known as sold out sensors) for detecting the level of each of the micro-ingredients 304 in the cartridges. In some instances, the sold out sensors in the macro-ingredient rack 316 and/or the micro-ingredient tower 324 may be omitted.

In some instances, at least a portion of the beverage dispensing system 300 may be located in a backroom (or in a back of house (BOH)). For example, the macro-ingredient rack 316 and the associated macro-pumps 318, macro-sensors 320, and macro-ingredients 302 may be located in the BOH or elsewhere. The beverage dispensing system 300, and any portions thereof, however, may be located anywhere.

The beverage dispensing system 300 may further include a dispenser portion 303 having a user interface 328, a recipe database 330, dispense controls 332, and a network module 334, all in electrical communication with one another. The dispense controls 332 may be in electrical communication with a number of macro-flow controls 336 disposed about the macro-conduit 308. Likewise, the dispense controls 332 may be in electrical communication with a number of micro-flow controls 338 disposed about the micro-conduit 310. In this manner, the macro-flow controls 336 and the micro-flow controls 338 may be electronically connected to the dispense controls 332 and fluidly connected to the macro-ingredients 302 and the micro-ingredients 304, respectively. In addition, a number of micro-pumps 340 may be disposed with and/or adjacent to the micro-flow controls 338. The micro-pumps 340 may be metering pumps (e.g., solenoid or nutating pumps). Furthermore, the sold out sensors 320, 326 may be in electrical communication with the network module 334.

In some instances, at least a portion of the beverage dispensing system 300 may be located in a front room (or a front of house (FOH) or a pick-up window (PUW)). For example, the user interface 328, recipe database 330, dispense controls 332, network module 334, macro-flow controls 336, micro-flow controls 338, micro-pumps 340, ice bath 314, and nozzle 306 may be disposed in the FOH/PUW. The beverage dispensing system 300, and any portions thereof, however, may be located anywhere.

In operation, a user can select, via the user interface 328, a predetermined recipe saved in the recipe database 330. Based on the user selection, the dispense controls 332 may activate, via the macro-flow controls 336 and/or the micro-flow controls 338, one or more of the macro-pumps 318 and/or the micro-pumps 340, respectively, to flow at a desired flow rate to achieve the selected recipe. The sold out sensors 320, 326 may be in fluid communication and proximate to the macro-ingredients 302 and the micro-ingredients 304 to notify the dispense controls 332 via the network module 334 that an ingredient is sold out and needs to be replaced prior to pouring another beverage including that ingredient.

Figure 19:
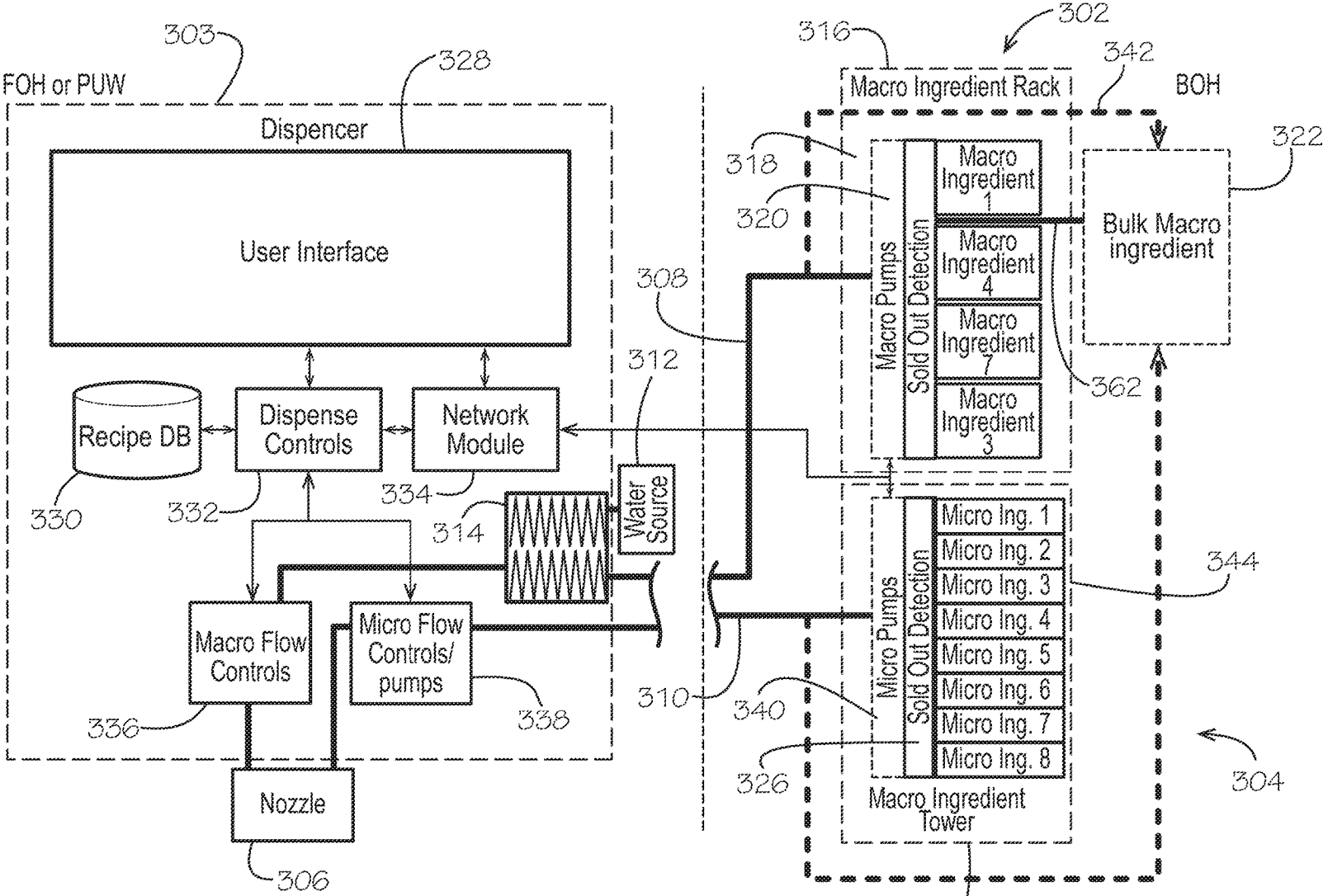
FIG. 19 depicts an example beverage dispenser in accordance with one or more embodiments of the disclosure.

FIG. 19 depicts a beverage dispensing system 400. The beverage dispensing system 400 is similar to the beverage dispensing system 300 depicted in FIG. 18. The beverage dispensing system 400, however, includes the bulk macro-ingredient 322 being in fluid communication with the macro-ingredients 302 via a macro-tap conduit 342 and the micro-ingredients 304 via a micro-tap conduit 344. In this manner, as discussed in greater detail below, the bulk macro-ingredient 322 may be made on demand (e.g., when the bulk macro-ingredient 322 reaches a low volume reading from a bulk sensor) from one or more of the macro-ingredients 302 and/or one or more of the micro-ingredients 304. In addition, in the beverage dispensing system 400, the micro-pumps 340 may be located proximate to the micro-ingredients 304 within the micro-ingredients tower 324 rather than proximate to the micro-flow controls 338.

Figure 20:
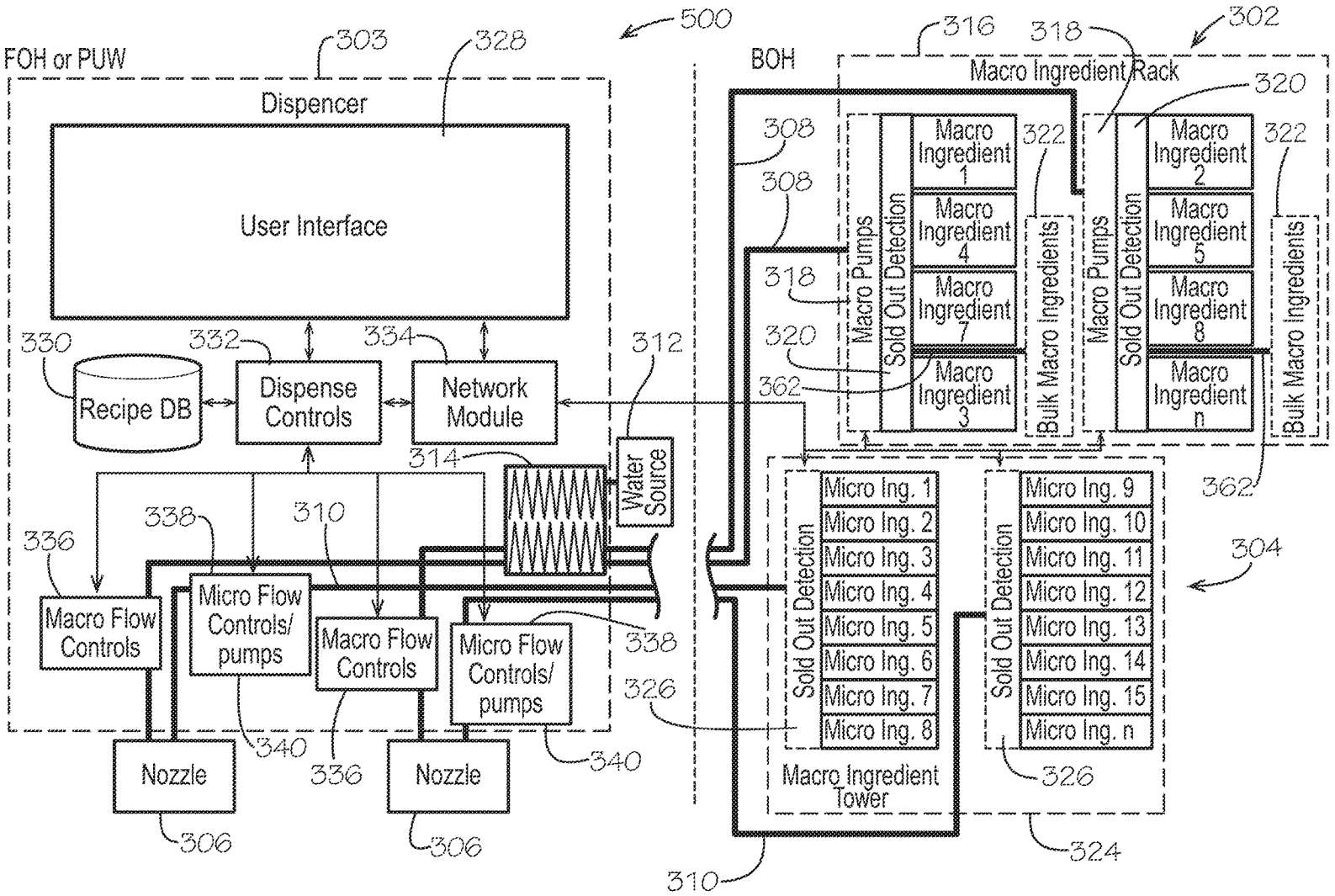
FIG. 20 depicts an example beverage dispenser in accordance with one or more embodiments of the disclosure.

FIG. 20 depicts a beverage system 500. The beverage dispensing system 500 is similar to the beverage dispensing systems 300 and 400. The beverage dispensing system 500, however, includes more than one nozzle 306. Any number of nozzles 306 may be used. As depicted in FIG. 20, each of the nozzles 306 are in fluid communication with corresponding macro-ingredients 302 and micro-ingredients 304 similar to the configuration disclosed in FIG. 18. It is noted, however, that one or more of the nozzles 306 may alternatively be in in fluid communication with corresponding macro-ingredients 302 and micro-ingredients 304 similar to the configuration disclosed in FIG. 19. For example, the micro-pumps 340 could be located within the micro-ingredients tower 324. In addition, the macro-tap conduit 342 and the micro-tap conduit 344 could be incorporated into the embodiment shown in FIG. 20 for fluidly connecting the macro-ingredients 302 and micro-ingredients 304, respectively, with the bulk macro-ingredient 322.

Figure 21:
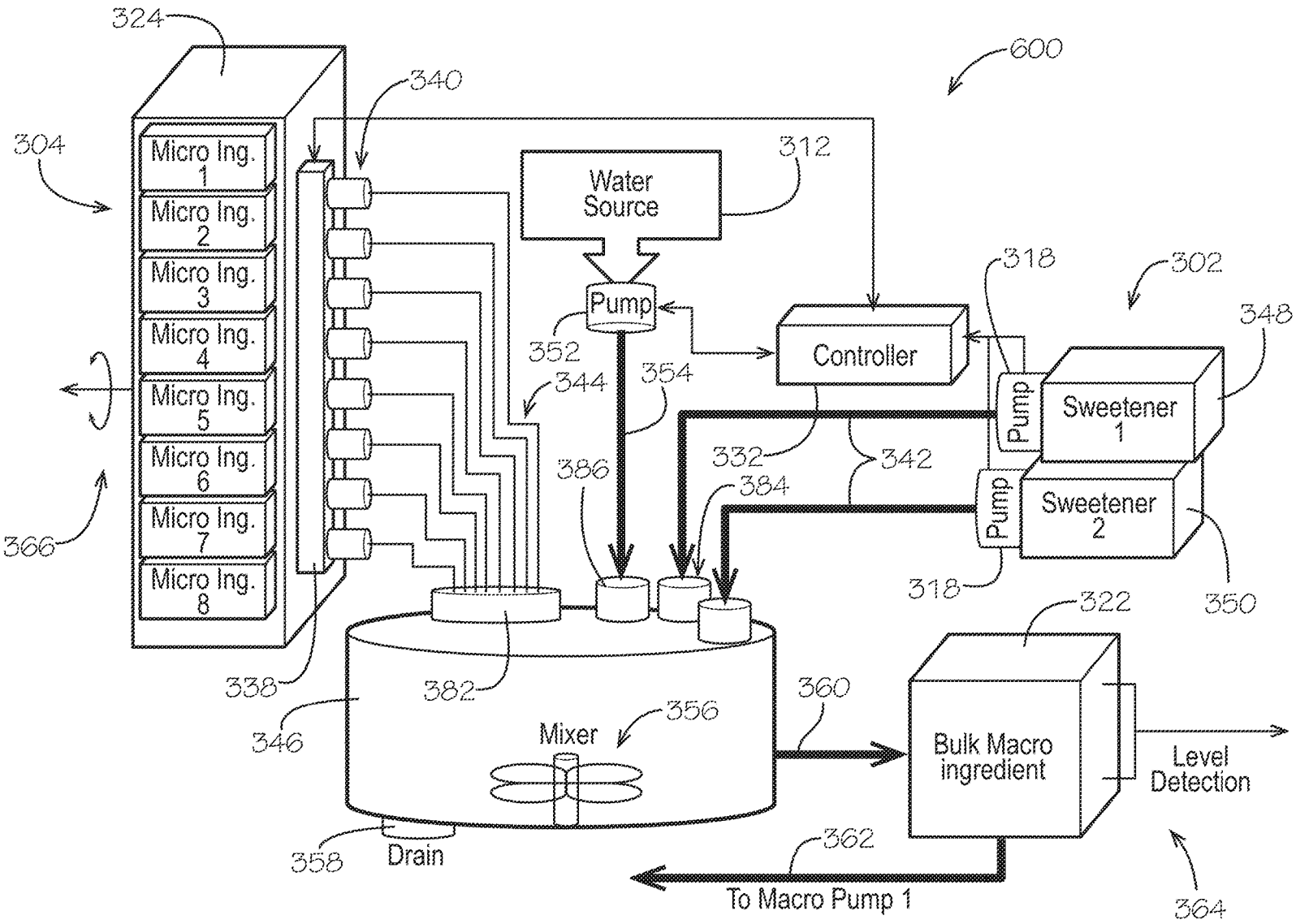
FIG. 21 depicts an example beverage dispenser in accordance with one or more embodiments of the disclosure.

In certain embodiments, as depicted in FIG. 21, one or more macro-ingredients 302 and/or one or more micro-ingredients 304 may be combined in a mixing chamber 346 to form the bulk macro-ingredient 322. For example, a bulk-macro system 600 is depicted in FIG. 21. In the bulk-macro system 600, the macro-ingredients 302 may include a first macro-ingredient 348 (e.g., a first sweetener) and a second macro-ingredient 350 (e.g., a second sweetener). Any number or type of macro-ingredients 302 may be used. The first macro-ingredient 348 and the second macro-ingredient 350 may be disposed within the macro-ingredient rack 316 or elsewhere. One or more of the macro-ingredients 302 may be pumped via a pump 318 and the macro-tap conduit 342 to the mixing chamber 346. Similarly, one or more of the micro-ingredients 304 may be pumped 340 via the micro-tap conduit 344 to the mixing chamber 346. In addition, water from the water source 312 may be pumped via a water pump 352 along a water conduit 354 to the mixing chamber 346. One or more valves 382, 384, 386 may control the flow of fluids to the mixing chamber 346. The mixing chamber 346 may include an agitation device 356 or other mixing device therein to effectively achieve the desired homogenous mix of ingredients. The mixing chamber 346 also may include a drain 358.

The mixture within the mixing chamber 346 may be supplied to the bulk macro-ingredient container via a conduit 360. The bulk macro-ingredient 322 may then be supplied to the other macro-pumps 318 via a conduit 362. The bulk macro-mixing system may generate additional bulk macro-ingredient 322 when a level detection device 364 indicates a low level of the bulk macro-ingredient 322. The controller 332 may be in electrical communication with the various pumps, controllers, valves, etc. to control the fluid flow within the system.

In some instances, the mixing chamber 346 can be flushed with water and drained for cleaning. For example, if a tea flavored bulk macro-ingredient is needed, a tea flavor micro-ingredient may be dispensed in a predetermined quantity as directed by the controller 332 into the mixing chamber 346 along with a specified amount of one or more of the macro-ingredients 302. If a branded beverage base is needed, then the requisite ingredients (e.g., an acid and a food degradable acid) may be simultaneously or serially dispensed along with the requisite other diluents into the mixing chamber 346. As noted above, the micro-ingredient tower 324 may include an agitation device 366. For example, the ingredients in the micro-ingredient cartridges may require periodic agitation to maintain homogeneity. In addition, the micro-ingredient cartridges may be in fluid communication with a recirculation pump (not shown) for recirculating the ingredients in the micro-ingredient cartridges to maintain homogeneity via a continuous flow of the micro-ingredients 304 to prevent separation thereof.

Figure 22:
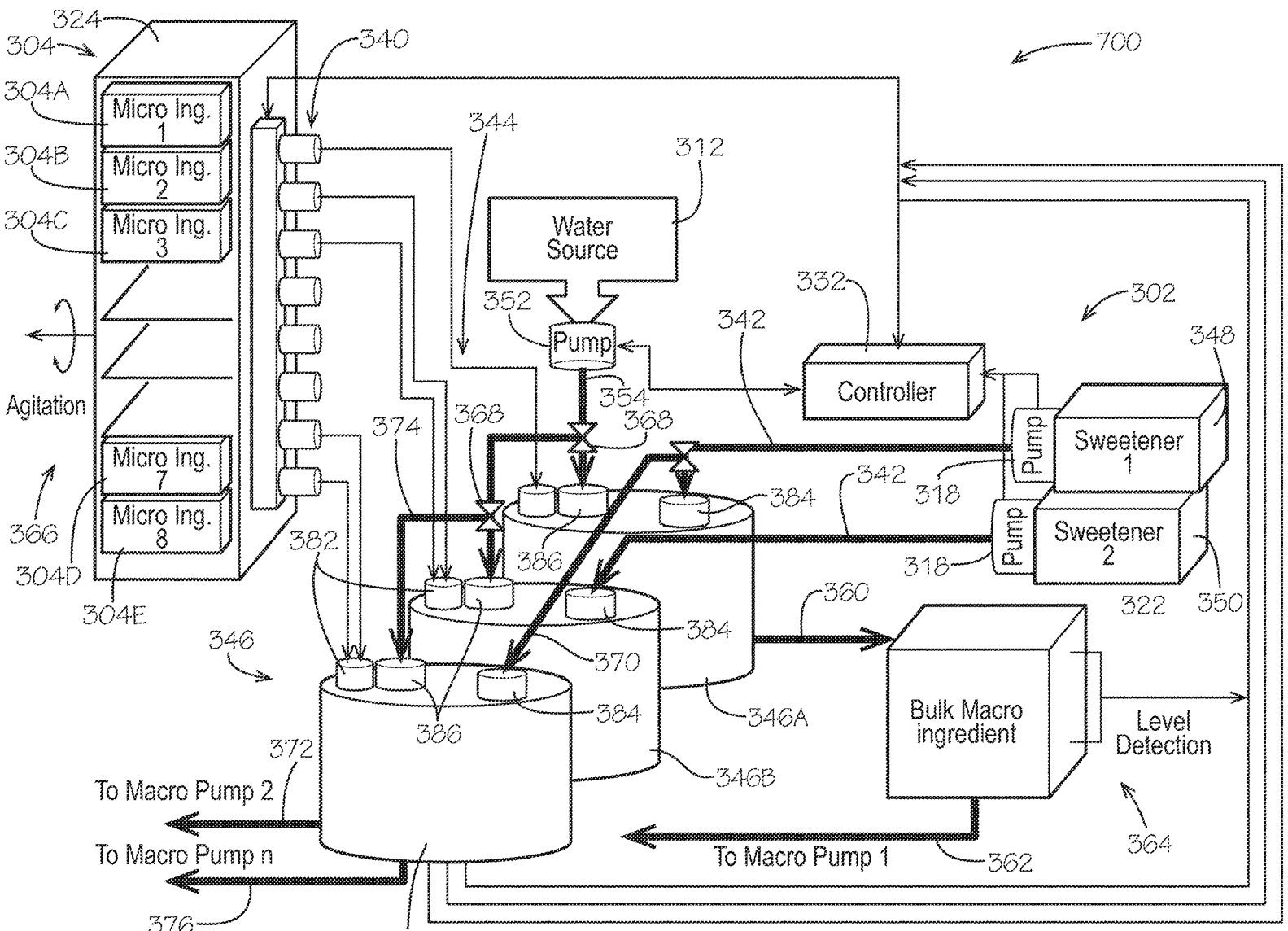
FIG. 22 depicts an example beverage dispenser in accordance with one or more embodiments of the disclosure.

FIG. 22 depicts an example of a bulk-macro system 700 where there are multiple mixing chambers 346 such that each of the mixing chambers 346 are configured to make a specific macro-ingredient from the one or more of the macro-ingredients 302 (e.g., a sweetener), the one or more of the micro-ingredients 304, and/or water. The controller 332 is configured to control one or more valves 368, pumps 318, 340, and controllers 338 to direct the water, the one or more macro-ingredients 302, and the one or more micro-ingredients 304 to the correct mixing chamber 346 for mixing.

In this manner, FIG. 22 depicts an alternate embodiment where there are a number of independent mixing chambers 346 dedicated to a particular ingredient mix so that flushing of the mixing chambers 346 may not be required. For example, one or more of the micro-ingredients 304 may be fluidly connected to a specific mixing chamber 346. The one or more valves 368 in communication with the controller 332 may be adjusted to determine which macro-fluid path 370 to open for the given mixing chamber 346 to be filled with water and/or the macro-ingredients 302. That is, the valves 368 may control which macro-fluid path 370 and/or water path 374 is opened to supply the specific mixing chamber 346.

In one example embodiment, a first mixing chamber 346A may be in fluid communication with the water, the first macro-ingredient 348, and a first micro-ingredient 304A. The mixture within the first mixing chamber 346A may be supplied to the bulk macro-ingredient container via the conduit 360. A second mixing chamber 346B may be in fluid communication with the water, the second macro-ingredient 350, a second micro-ingredient 304B, and a third micro-ingredient 304C. The mixture within the second mixing chamber 346B may be supplied to another container or directly to the nozzle 306 via the conduit 372 via one of the macro-pumps 318. A third mixing chamber 346*n* may be in fluid communication with the water, the first macro-ingredient 348, a fourth micro-ingredient 304D, and a fifth micro-ingredient 304E. The mixture within the third mixing chamber 346*n* may be supplied to another container or directly to the nozzle 306 via the conduit 376 via one of the macro-pumps 318. Any number of mixing chambers 346, pumps, valves, control mechanism, etc. may be used. In addition, any number of macro-ingredients 302 and/or micro-ingredients 304 may be supplied to each of the mixing chambers 346.

Figure 23:
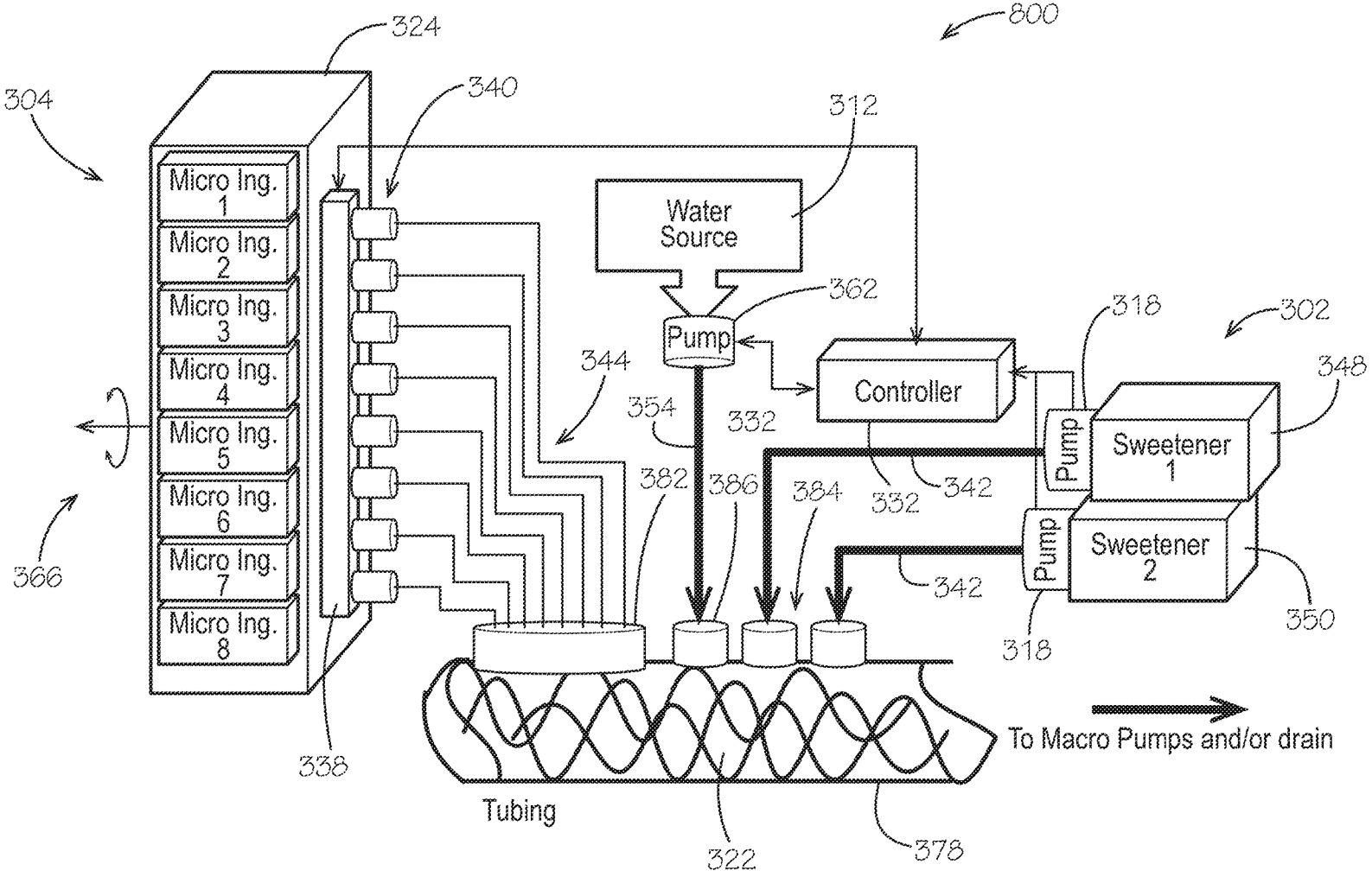
FIG. 23 depicts an example beverage dispenser in accordance with one or more embodiments of the disclosure.

FIG. 23 depicts a bulk-macro system 800 in which the bulk macro-ingredient 332 is mixed on demand for dispensing. For example, the bulk macro-ingredient 322 may be created from mixing one or more of the macro-ingredients 302 (e.g., one or more of the sweeteners 348, 350) with one or more of the micro-ingredients 304 and water. The ingredients may be mixed on demand as needed. In the bulk-macro system 800, the bulk macro-ingredient 322 may be created without a mixing chamber or holding tank. Instead, the water, the one or more macro-ingredients 302, and the one or more micro-ingredients 304 may be dispensed into a tube 378 at specified flowrates in order to create the bulk macro-ingredient 322. A number of valves 382 may control which and how much of the micro-ingredients 304 are dispensed into the tube 378. Likewise, one or more valves 384 may control which and how much of the macro-ingredients 302 are dispensed into the tube 378. A water valve 386 may also be used to control the flow of water into the tube 378. The injection rate of the ingredients and the length and/or path of the tube 378 may enable the proper mixing of the ingredients, resulting in the bulk macro-ingredient 322 having the desired homogenous mixture, which may then be supplied to the nozzle 306 or elsewhere. In some instances, the tube 378 can be flushed with water and drained.

Figure 24:
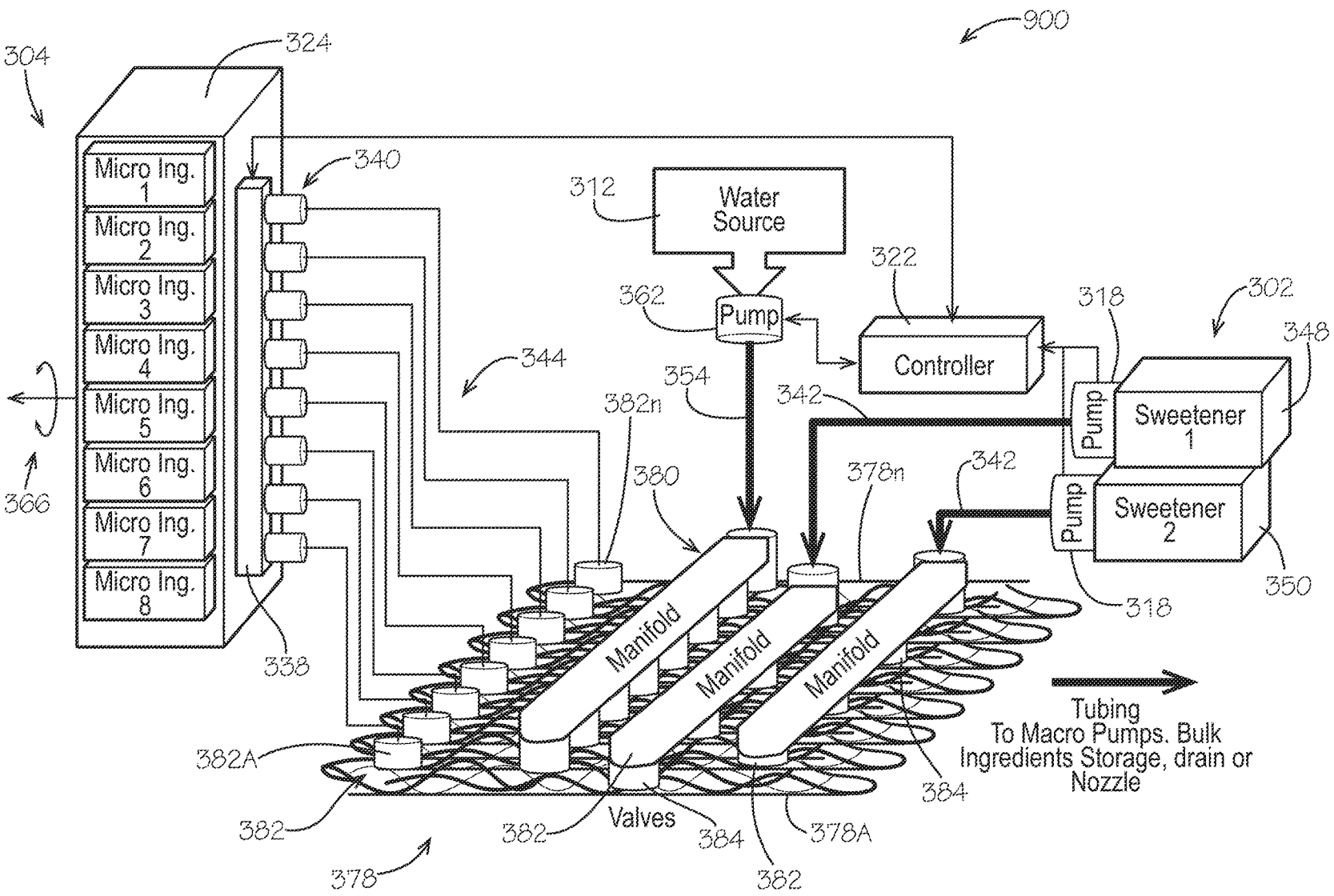
FIG. 24 depicts an example beverage dispenser in accordance with one or more embodiments of the disclosure.

FIG. 24 depicts a bulk-macro system 900 in which the bulk macro-ingredient 332 is mixed on demand for dispensing. The bulk-macro system 900 is similar to the bulk-macro system 800, except instead of one tube 378, a number of tubes 378A to 378*n* are used. That is, multiple tubes may be used to create a specific bulk macro-ingredient 322 such that no flushing is required to avoid contamination should a different bulk macro-ingredient 322 be needed at the nozzle 306. The 378 tubes can also be flushed with water and drained.

In an example embodiment, each of the micro-ingredients 304 may be in fluid communication with a specific tube 378A to 378*n*. A valve 382A to 382*n* may be disposed between each of the micro-ingredient 304 and tube 378 combinations. In this manner, each tube 378 is supplied a specific micro-ingredient 304. In addition, each of the tubes 378 may be supplied a macro-ingredient 302 via a macro-manifold 382. The valves 384 may control the supply of the macro-ingredient 302 out of the macro-manifold 382. Each tube 378 may have a designated valve 384 between the tube 378 and the macro-manifold 382. Furthermore, each of the tubes 378 may be supplied water via a water-manifold 380. The valves 386 may control the supply of the water out of the water-manifold 380. Each tube 378 may have a designated valve 386 between the tube 378 and the water-manifold 380.

In this manner, a number of the bulk macro-ingredients 322 may be created from mixing one or more of the macro-ingredients 302 (e.g., one or more of the sweeteners 348, 350) with one or more of the micro-ingredients 304 and water. The ingredients may be mixed on demand as needed. In the bulk-macro system 900, the bulk macro-ingredients 322 may be created without a mixing chamber or holding tank. That is, each tube 378 may mix the ingredients therein. As a result, each tube 378 is configured to provide a specific bulk macro-ingredient 322 for dispensing.

Alternatively one or more micro ingredients and/or macro ingredients (such as sweeteners) could be used to make the bulk macro ingredient. For example, both nutritive and non-nutritive sweetener mixed with water, an acid and an acid degradable flavor ingredient could be combined as a bulk macro to create a mid-calorie post mix beverage.

FIGS. 18-24 depict various hybrid beverage dispensers having both macro-ingredient and micro-ingredient fluidics and control architectures where the ingredients may all be located in the back room. Micro-pumps (any metering pump such as a positive displacement solenoid or nutating pump) may be located in the dispenser or proximate to the micro-ingredients. Sold out sensors may be placed at the outlets of the ingredient cartridges (including BIB and bulk tanks).

When a cartridge is replaced after sold out, the pump may run backwards to remove any air in the line back into the new pouch, bag, or tank. The pump may run forward the same amount it ran backwards to ensure the line is primed and ready to pour without wasting any ingredient. Micro-ingredients requiring agitation can be placed on an agitation tower and made into macro-ingredients on demand either via a mixer into a holding tank or directly into a macro-ingredient line. All lines/mixers can be flushed. Beverages are recipe based (not flavor shots) and bulk macro-ingredients can be made fresh on demand or come from existing BIBs or other bulk storage systems.

Although specific embodiments of the disclosure have been described, numerous other modifications and alternative embodiments are within the scope of the disclosure. For example, any of the functionality described with respect to a particular device or component may be performed by another device or component. Further, while specific device characteristics have been described, embodiments of the disclosure may relate to numerous other device characteristics. Further, although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among others, "can," "could," "might," or "may," unless specifically stated otherwise, or otherwise understood within the context as used, is generally intended to convey that certain embodiments could include, while other embodiments may not include, certain features, elements, and/or steps. Thus, such conditional language is not generally intended to imply that features, elements, and/or steps are in any way required for one or more embodiments.

That which is claimed is:

1. A method for dispensing one or more beverages, the method comprising:

replacing a legacy nozzle on a first legacy beverage dispenser comprising at least one macro-ingredient with a retrofitted nozzle configured to accommodate the at least one macro-ingredient of the first legacy beverage dispenser and a plurality of micro-ingredients;

providing a second retrofitted beverage dispenser separate from the first legacy beverage dispenser and in communication with the retrofitted nozzle of the first legacy beverage dispenser, wherein the second retrofitted beverage dispenser comprises the plurality of micro-ingredients;

receiving an order for a beverage from a user interface of the first legacy beverage dispenser;

communicating the order to the second retrofitted beverage dispenser in communication with the first legacy beverage dispenser; and dispensing from the retrofitted nozzle of the first legacy beverage dispenser a beverage formed by the at least one macro-ingredient from the first legacy beverage dispenser and one or more of the plurality of micro-ingredients from the second retrofitted beverage dispenser.

* * * * *